US007299775B2

(12) United States Patent
Tateno et al.

(10) Patent No.: US 7,299,775 B2
(45) Date of Patent: Nov. 27, 2007

(54) VARIABLE VALVE OPERATING DEVICE

(75) Inventors: Manabu Tateno, Sunto-gun (JP); Toshiaki Asada, Mishima (JP); Shuichi Ezaki, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 31 days.

(21) Appl. No.: 10/578,520

(22) PCT Filed: Aug. 30, 2005

(86) PCT No.: PCT/JP2005/016185

§ 371 (c)(1),
(2), (4) Date: May 8, 2006

(87) PCT Pub. No.: WO2006/025565

PCT Pub. Date: Mar. 9, 2006

(65) Prior Publication Data

US 2007/0095311 A1 May 3, 2007

(30) Foreign Application Priority Data

Aug. 31, 2004 (JP) ..... 2004-252559

(51) Int. Cl.
*F01L 1/34* (2006.01)

(52) U.S. Cl. ..... 123/90.16; 123/90.15; 123/90.17; 123/90.31

(58) Field of Classification Search ..... 123/90.16
See application file for complete search history.

(56) References Cited

U.S. PATENT DOCUMENTS 6,357,405 B1 * 3/2002 Tsuji et al. ..... 123/90.16
7,213,551 B2 * 5/2007 Asada et al. ..... 123/90.16

FOREIGN PATENT DOCUMENTS

| | | |
|---|---|---|
| JP | A 64-053009 | 3/1989 |
| JP | A 06-017628 | 1/1994 |
| JP | A 06-074011 | 3/1994 |
| JP | A 06-093816 | 4/1994 |
| JP | A 06-307219 | 11/1994 |
| JP | A 07-063023 | 3/1995 |
| JP | A 11-036833 | 2/1999 |
| JP | A 2001-164911 | 6/2001 |
| JP | A 2002-371816 | 12/2002 |
| JP | A 2003-239712 | 8/2003 |
| JP | A 2004-108302 | 4/2004 |
| WO | WO 2005/038211 | 4/2005 |

* cited by examiner

*Primary Examiner*—Thomas Denion
*Assistant Examiner*—Kyle M. Riddle
(74) *Attorney, Agent, or Firm*—Oliff & Berridge, PLC

(57) ABSTRACT

A variable valve operating device is provided that allows an ideal valve timing-lift characteristic to be realized by associating a change in a valve timing with a change in a valve lift amount. A rotation motion of a drive cam is transmitted to a slide surface of a swing member via an intermediate member. Positions of the intermediate member on the slide surface are varied in association with the rotation of a control shaft by an interlock mechanism. The slide surface is formed to be curved toward the drive cam so that the distance from the center of a camshaft increases toward the farthest point from the swing center of the swing member within the area which the intermediate member contacts from the nearest point from the swing center of the swing member within the area which the intermediate member contacts.

11 Claims, 20 Drawing Sheets

VARIABLE VALVE OPERATING DEVICE

TECHNICAL FIELD

The present invention relates to a variable valve operating device for an internal combustion engine, and more particularly, to a variable valve operating device that allows the operating characteristic of a valve to be changed mechanically.

BACKGROUND ART

A conventional variable valve operating device is known, as disclosed, for example, in Japanese Patent Laid-open No. 2003-239712, in which the valve lift amount and valve timing are mechanically changed according to engine operating conditions. In the variable valve operating device (hereinafter referred to as prior art) disclosed in Japanese Patent Laid-open No. 2003-239712, a control arm is fixed to a control shaft disposed in parallel with a camshaft and one end portion of a follower is mounted on the control arm and allowed to swing freely. Further, a swing cam is mounted on the control shaft and allowed to swing freely. A rocker arm is pressed against a cam surface of the swing cam. A first roller and a second roller that are rotatable mutually independently of each other are coaxially mounted on the follower. The first roller abuts against a valve cam of the camshaft. The second roller abuts against a flat surface (abutment surface) of the swing cam formed on a side opposite to the swing cam surface.

According to these arrangements, a rotational position of the control arm is changed through rotation of the control shaft. This displaces the follower to thereby change the distance between the control shaft and the point of abutment between the swing cam and the second roller, whereby the valve lift amount is changed. This also changes a circumferential position of the valve cam that abuts on the first roller at the same rotational angular position of the camshaft, which results in the valve timing being changed. Specifically, according to the prior art disclosed in Japanese Patent Laid-open No. 2003-239712, the valve lift amount and valve timing can be changed simultaneously by controlling the rotation position of the control shaft using a motor.

Including the above-mentioned document, the applicant is aware of the following documents as a related art of the present invention.

[Patent Document 1]
Japanese Patent Laid-open No. 2003-239712
[Patent Document 2]
Japanese Patent Laid-open No. Hei 7-63023
[Patent Document 3]
Japanese Patent Laid-open No. 2002-371816
[Patent Document 4]
Japanese Patent Laid-open No. 2004-108302

DISCLOSURE OF THE INVENTION

In the aforementioned prior art, when the follower is displaced by the change in the rotational position of the control arm, the swing cam rotates as it follows displacement of the follower. Rotation of the swing cam results in the position of abutment between the swing cam surface and the rocker arm being changed. In the aforementioned prior art, the position of abutment between the swing cam surface and the rocker arm moves toward the side of a greater valve lift amount at shorter distances between the control shaft and the point of abutment between the swing cam and the second roller. Specifically, the valve lift amount is changed by not only the change in the distance between the control shaft and the point of abutment between the swing cam and the second roller, but also the change in the position of abutment between the swing cam surface and the rocker arm.

Accordingly, in the aforementioned prior art, the change in valve timing is smaller as compared with the change in the valve lift amount. There is therefore a likelihood that an amount of change in the valve timing required relative to the change in the valve lift amount required will not be achieved.

Known also in addition to the prior art variable valve operating device is a variable valve timing mechanism, what is commonly called VVT, which variably controls valve timing by changing a phase angle of the camshaft relative to a crankshaft. If this variable valve timing mechanism is used in combination, it becomes possible to correct the change in valve timing that is insufficient in the variable valve operating device to a desired one. An increased cost is, however, involved with this case. Not only that, but it also becomes necessary to provide coordinated control of both the variable valve operating device and the variable valve timing mechanism. This entails a control lag or the like. Accordingly, it is not necessarily possible to achieve an ideal valve timing-lift characteristic at all times.

The present invention addresses these problems discussed above and it is an object of the present invention to provide a variable valve operating device capable of achieving an ideal valve timing-lift characteristic by associating changes in valve lift amount with changes in valve timing.

The above object is achieved by a variable valve operating device according to a first aspect of the present invention. The variable valve operating device mechanically changes the operating characteristic of a valve relative to rotation of a camshaft. The variable valve operating device includes a drive cam disposed on the camshaft and a control shaft disposed to extend in parallel with the camshaft. The control shaft is capable of changing the rotation position continuously or stepwise. The variable valve operating device also includes a swing member swinging about an axis extending in parallel with the camshaft. A swing cam surface is formed on the swing member. The swing cam surface makes in contact with a valve support member for supporting the valve to press the valve in a lifting direction. A slide surface is also formed on the swing member so as to oppose the drive cam. An intermediate member is disposed between the drive cam and the swing member. The intermediate member makes in contact with both a cam surface of the drive cam and the slide surface. Further, the variable valve operating device includes an interlock mechanism. The interlock mechanism changes a position of the intermediate member on the slide surface by interlocking with the rotation of the control shaft. The slide surface is formed to be curved toward the drive cam so that the distance from the center of the camshaft increases from the nearest point from the swing center of the swing member toward the farthest point from the swing center of the swing member within the area which the intermediate member contacts. The swing cam surface includes a nonoperating surface having a constant distance from the swing center of the swing member and giving the valve no lift and an operating surface disposed to continue into the nonoperating surface so that the distance from the swing center of the swing member becomes gradually greater. A contact position of the valve support member on the swing cam surface shifts from the nonoperating surface to a side of the operating surface as the swing member swings.

When the rotation position of the control shaft is varied in the first aspect of the present invention, the rotation of the control shaft is transmitted to the intermediate member via the interlock mechanism. As a result, the position of the intermediate member on the slide surface is changed. The change in the position of the intermediate member on the slide surface changes a swing angle and an initial swing position of the swing member. Specifically, the swing angle of the swing member becomes small as the intermediate member moves toward a leading end side on the slide surface. Further, according to the shape of the slide surface, the swing member inclines so that the initial swing position of the swing member causes the initial position of the valve support member on the swing cam surface to leave the operating surface. The contact position of the valve support member on the swing cam surface moves from the nonoperating surface to the side of the operating surface as the swing member swings. The valve lift amount of the valve is determined by the position on the operating surface to be reached by the valve support member. The valve working angle is determined by the crank angle during which the valve support member remains located on the operating surface. The valve lift amount and the working angle are therefore decreased when the swing angle of the swing member is small. Further, the initial position of the valve support member on the swing cam surface leaves the operating surface according to the change of the initial swing position of the swing member. This increases the crank angle during which the valve support member travels on the nonoperating surface, which further decreases the working angle. Accordingly, according to the first aspect of the present invention, the working angle can be clearly varied in accordance with the change in the valve lift amount.

The change in the position of the intermediate member on the slide surface also changes the position of the intermediate member on the drive cam surface when the camshaft is at the same rotation position. The change in the position of the intermediate member on the drive cam surface results in the swing timing of the swing member relative to the phase of the camshaft being changed. The valve timing is thus varied. At this time, the arrangement of the slide surface being formed to be curved to the drive cam side helps suppress an excessive change in the initial swing position of the swing member relative to the change in the position of the intermediate member on the drive cam surface. Accordingly, according to the first aspect of the present invention, changes in the valve lift amount and the working angle can be appropriately suppressed relative to the change in the valve timing.

From the foregoing, in accordance with the first aspect of the present invention, it is possible to achieve an ideal valve timing-lift characteristic by not only varying the valve lift amount and working angle in association with the valve timing, but also optimizing the relationship among the valve lift amount, working angle, and valve timing without using in combination the variable valve timing mechanism or without having to let the variable valve timing mechanism, should one be used in combination, operate largely.

According to a second aspect of the present invention, in the variable valve operating device according to the first aspect of the present invention, the slide surface may be formed so that the distance from the center of the camshaft increases with an increase in the distance from the swing center of the swing member.

According to the second aspect of the present invention, the valve lift amount and the working angle become smaller as the intermediate member moves toward a leading end side on the slide surface. Therefore, changes in the valve lift amount and the working angle are interlocked with the change in the valve timing. This makes it possible to set the relation between the valve timing, and the valve lift amount and the working angle as 1 to 1.

According to a third aspect of the present invention, in the variable valve operating device according to the first or second aspect of the present invention, a position of the drive cam in contact with the intermediate member in a circumferential direction at the same rotation position of the camshaft may move to an advance side of the camshaft as the position of the intermediate member on the slide surface is further away from the swing center of the swing member.

When the position in the circumferential direction of the drive cam contacting the intermediate member at the same rotation position of the camshaft moves toward the advance side of the camshaft, the swing timing of the swing member advances, which advances the valve timing. In accordance with the third aspect of the present invention, since the valve timing advances as the intermediate member moves toward the leading end of the slide surface, valve timing-lift characteristic can be achieved that allows the valve timing to advance in response to a decrease in the valve lift amount and working angle.

According to a fourth aspect of the present invention, in the variable valve operating device according to any one of the first to third aspects of the present invention, the intermediate member may include a first roller that makes in contact with the cam surface of the drive cam and a second roller that is rotatable relative to the first roller and makes in contact with the slide surface.

According to the fourth aspect of the present invention, the variable valve operating device includes two rollers as the intermediate member, each being rotatable independently of each other, and the first roller makes contact with the cam surface of the drive cam, while the second roller makes contact with the slide surface. Accordingly, it is possible to reduce friction loss within a transmission system for a driving force from the camshaft to the valve, allowing the valve lift motion to be made even more efficiently.

According to a fifth aspect of the present invention, in the variable valve operating device according to any one of the first to fourth aspects of the present invention, the swing member may be rotatably mounted on the control shaft and rocks about the control shaft.

According to the fifth aspect of the present invention, the control shaft serves also as a shaft for the swing member. This not only simplifies the structure, but also enhances rigidity.

According to a sixth aspect of the present invention, in the variable valve operating device according to the fifth aspect of the present invention, the interlock mechanism may include a control member fixed to the control shaft and having a pivot at a position eccentric from the center of the control shaft and a connecting member mounted rockably on the pivot and connecting the intermediate member to the control member.

According to the sixth aspect of the present invention, the simple arrangement, in which the control member secured to the control shaft is connected to the intermediate member through the connecting member, allows the change in the position of the intermediate member on the slide surface to be associated with the rotation of the control shaft.

According to a seventh aspect of the present invention, in the variable valve operating device according to the sixth aspect of the present invention, the control member may be formed as a disc having a center at a position eccentric from the control shaft and the connecting member is mounted rotatably on an outer peripheral surface of the disc.

According to the seventh aspect of the present invention, the disc having the position eccentric from the control shaft defined as its center functions as the control member and the connecting member is mounted rotatably on the outer periphery of this disc. It is therefore possible to secure a high rigidity and, at the same time, achieve operating stability during operation at high speeds.

According to a eighth aspect of the present invention, in the variable valve operating device according to the fifth aspect of the present invention, the interlock mechanism may include a control member mounted rotatably on the camshaft, a support member mounted on the control member and supporting the intermediate member movably along a predetermined path, and a rotation interlock mechanism for interlocking the rotation of the control member about the camshaft with the rotation of the control shaft.

According to the eighth aspect of the present invention, the support member supporting the intermediate member and the control member are disposed around the existing camshaft. This allows the entire device to be built compactly.

According to a ninth aspect of the present invention, in the variable valve operating device according to the eighth aspect of the present invention, the support member may be formed as a guide integrated with the control member.

According to the ninth aspect of the present invention, the support member is structured as the guide integrating the control member. Accordingly, only the swing member and the intermediate member are movable during the valve lift motion. This helps suppress an increase in the inertia mass of the entire movable portion.

According to a tenth aspect of the present invention, in the variable valve operating device according to the eighth aspect of the present invention, the support member may be formed as a link member mounted on the control member rockably about a position eccentric from the camshaft and providing a link coupling between the control member and the intermediate member.

According to the tenth aspect of the present invention, the link coupling is provided by the link member for the intermediate member to the control member. The intermediate member can be reliably positioned relative to the control member.

According to a eleventh aspect of the present invention, the variable valve operating device according to any one of the first to tenth aspects of the present invention may further include a second drive cam, a second swing member, a second swing cam surface, a third swing member and interlock selecting means. The second drive cam is disposed on the camshaft in juxtaposition with the drive cam. The second swing member is disposed coaxially with the swing member and is able to swing independently of the swing member. The second swing cam surface is formed on the second swing member and makes in contact with a valve support member for supporting a second valve disposed in juxtaposition with the valve to press the second valve in a lifting direction. The third swing member is disposed coaxially with the swing member and is able to swing independently of the swing member and the second swing member and making in contact with a cam surface of the second drive cam. The interlock selecting means selectively interlock the second swing member with either the swing member or the third swing member.

According to the eleventh aspect of the present invention, when the second swing member is interlocked with the aforementioned swing member, the operating characteristic of the second valve relative to the rotation of the camshaft can be continuously variable in accordance with the rotation amount of the control shaft. When the second swing member is interlocked with the third swing member, on the other hand, the operating characteristic of the second valve relative to the rotation of the camshaft becomes constant at all times. Accordingly, in accordance with the eleventh aspect of the present invention, it becomes possible to perform swirl control in the cylinders or to have only one of the valves take a pause by changing the operating characteristic between the two valves.

BEST MODE FOR CARRYING OUT THE INVENTION

First Embodiment

A first embodiment of the present invention will be described below with reference to FIGS. 1 through 15.

[Configuration of the Variable Valve Operating Device According to the First Embodiment]

Figure 1:
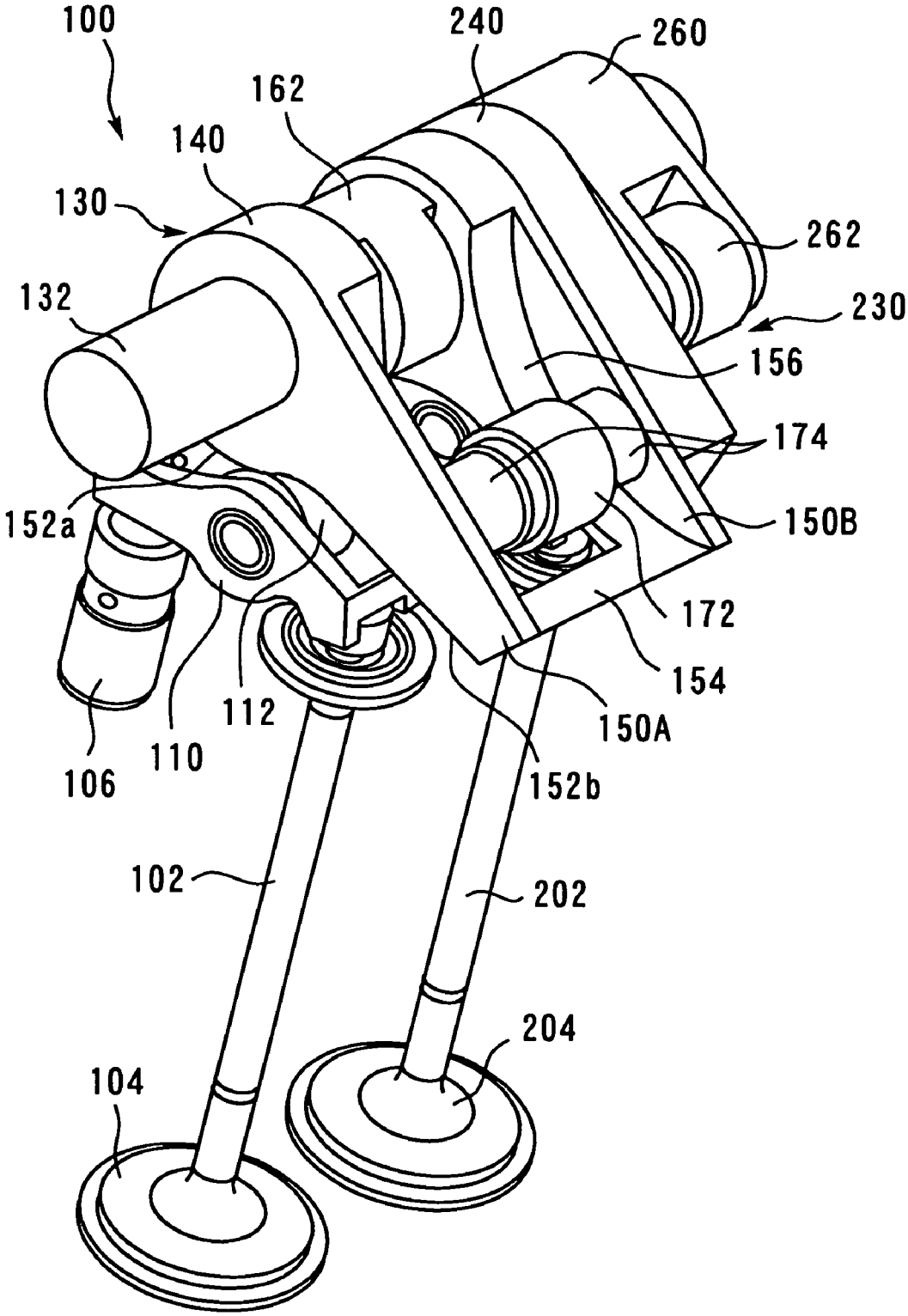
FIG. 1 is a perspective view showing the configuration of a variable valve operating device according to the first embodiment of the present invention.
Figure 2:
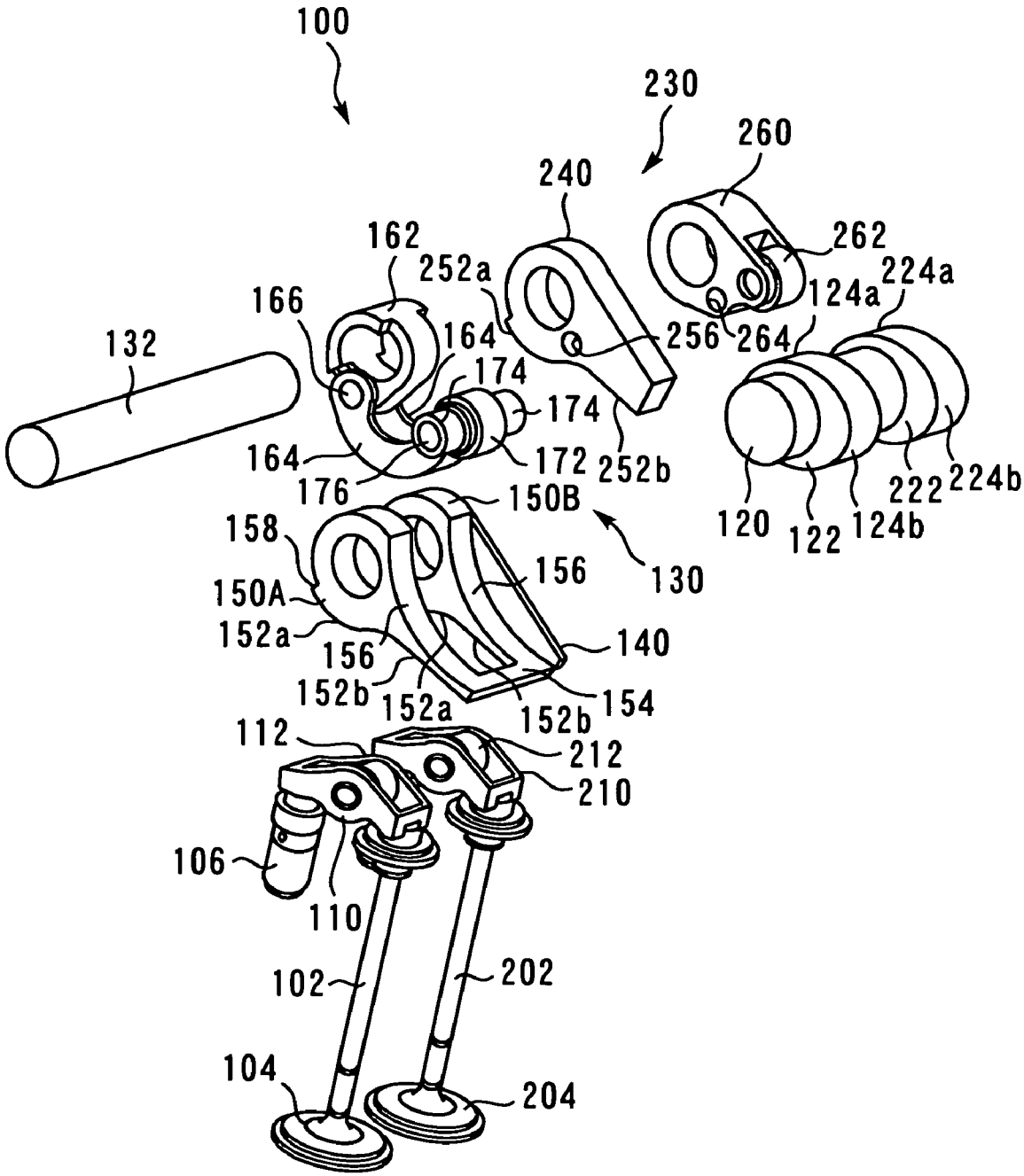
FIG. 2 is an exploded perspective view showing the configuration of the variable valve operating device according to the first embodiment of the present invention.
Figure 3:
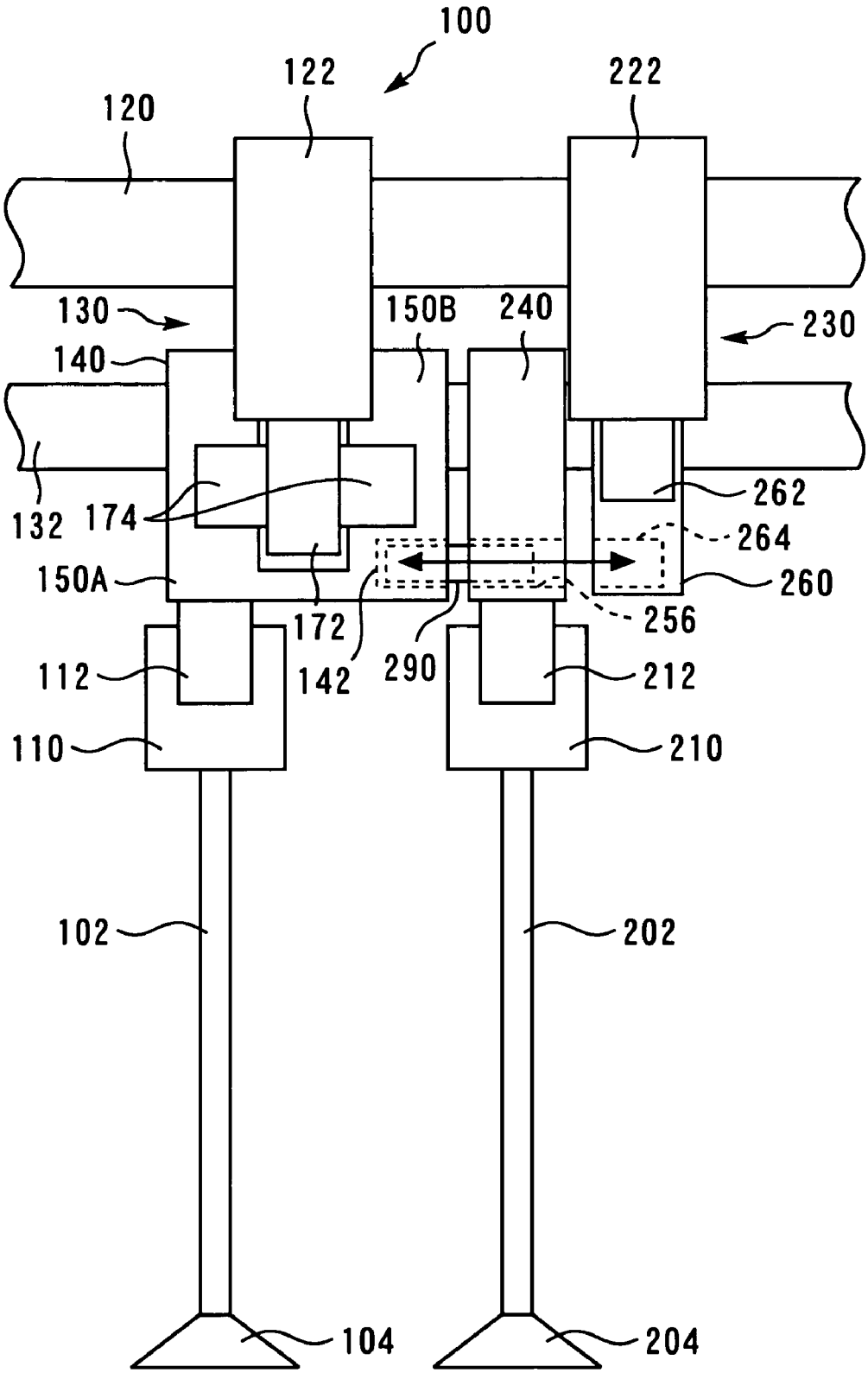
FIG. 3 is a front view showing schematically the configuration of the variable valve operating device according to the first embodiment of the present invention.

FIG. 1 is a perspective view showing the configuration of a variable valve operating device 100 according to the first embodiment of the present invention. FIG. 2 is an exploded perspective view showing the configuration of the variable valve operating device 100. FIG. 3 is a front view showing schematically the configuration of the variable valve operating device 100. The variable valve operating device 100 includes a mechanical valve operating mechanism of a rocker arm type. Rotation motion of a camshaft 120 is converted to a rocking motion of rocker arms (valve supporting members) 110, 210 by drive cams 122, 222 disposed on the camshaft 120. This is, in turn, converted to a lift motion in the vertical direction of valves 104, 204 supported by the rocker arms 110, 210, respectively.

The variable valve operating device 100 has two drive cams 122, 222 for the two rocker arms 110, 210. An adjustment mechanism 130 is disposed between a first drive cam 122 and each of the rocker arms 110, 210. The adjustment mechanism 130 interlocks the rotation motion of the first drive cam 122 with the rocking motion of each of the rocker arms 110, 210. A non-adjustment mechanism 230 is disposed between a second drive cam 222 and a second rocker arm 210. The non-adjustment mechanism 230 interlocks the rotation motion of the second drive cam 222 with the rocking motion of the second rocker arm 210.

The adjustment mechanism 130 continuously varies the condition of cooperative connection between the rotation motion of the first drive cam 122 and the rocking motion of each of the rocker arms 110, 210. The adjustment mechanism 130 includes, as major component members thereof, a control shaft 132, a control arm 162, a link arm 164, a first swing cam arm 140, a first roller 172, a second roller 174, and a second swing cam arm 240, as will be described below. The control shaft 132 is disposed to extend in parallel with, and be fixed relative to, the camshaft 120. The control shaft 132 can be controlled to be rotated through any arbitrary rotation position by an actuator not shown (e.g., a motor or the like).

The control arm 162 is integrally secured to the control shaft 132. The control arm 162 protrudes in a diametric direction of the control shaft 132. The link arm 164 is mounted on this protruding portion of the control arm 162. There are two link arms 164, each being disposed on either side of the control arm 162 so as to sandwich the control arm 162. A proximal end portion of each of the link arms 164 is rotatably coupled to the control arm 162 by a pin 166. The pin 166 is disposed eccentrically with respect to a center of the control shaft 132. The pin 166 defines the center of rocking of the link arms 164.

The link arms 164 are curved along the control shaft 132. A leading end portion of each of the right and left link arms 164 is connected to each other through a connecting shaft 176. The first roller 172 is disposed between the right and left link arms 164 and supported rotatably on the connecting shaft 176. The second rollers 174 having a smaller diameter than the first roller 172 are disposed on the outside of the corresponding link arms 164, respectively. Each of the second rollers 174 is rotatably supported on the connecting shaft 176. This allows the two rollers 172, 174 to rock about the pin 166 with a predetermined distance away from the pin 166. A drive cam surface 124 (124*a*, 124*b*) of the drive cam 122 contacts the first roller 162 and slide surfaces 156 to be described later contact the second rollers 174.

The drive cam surface 124 includes two cam surfaces having different profiles from each other. One of the two cam surfaces, a nonoperating surface 124*a*, is formed to keep a predetermined distance from the center of the camshaft 120. The other of the two cam surfaces, an operating surface 124*b*, is formed so that the distance from the center of the camshaft 120 gradually grows larger and, after a vertex portion, gradually grows smaller. In this specification, the nonoperating surface 124*a* and the operating surface 124*b* will be referred to simply as the drive cam surface 124 when one is not to be differentiated from the other.

The first swing cam arm 140 includes a first arm portion 150A, a second arm portion 150B, and a coupling portion 154. The first arm portion 150A and the second arm portion 150B are paired up and disposed to sandwich the control arm 162 on corresponding sides thereof. The coupling portion 154 couples leading ends of the right and left arm portions 150A, 150B. Both the right and left arm portions 150A, 150B are rockably supported on the control shaft 132. The leading ends of the right and left arm portions 150A, 150B are disposed to face an upstream side in the direction of rotation of the drive cam 122. The arm portions 150A, 150B are arranged to rock integrally about the control shaft 132. In this specification, the first arm portion 150A and the second arm portion 150B will be referred to simply as an arm portion 150 when one is not to be differentiated from the other.

Figure 4:
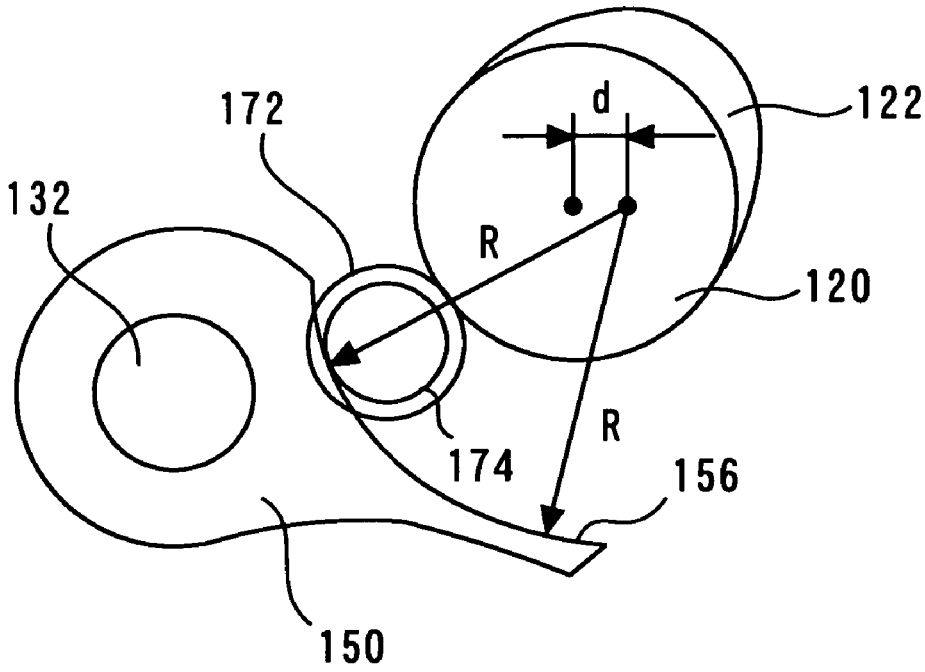
FIG. 4 is an illustration for the explanation about one method for forming the slide surface.
Figure 5:
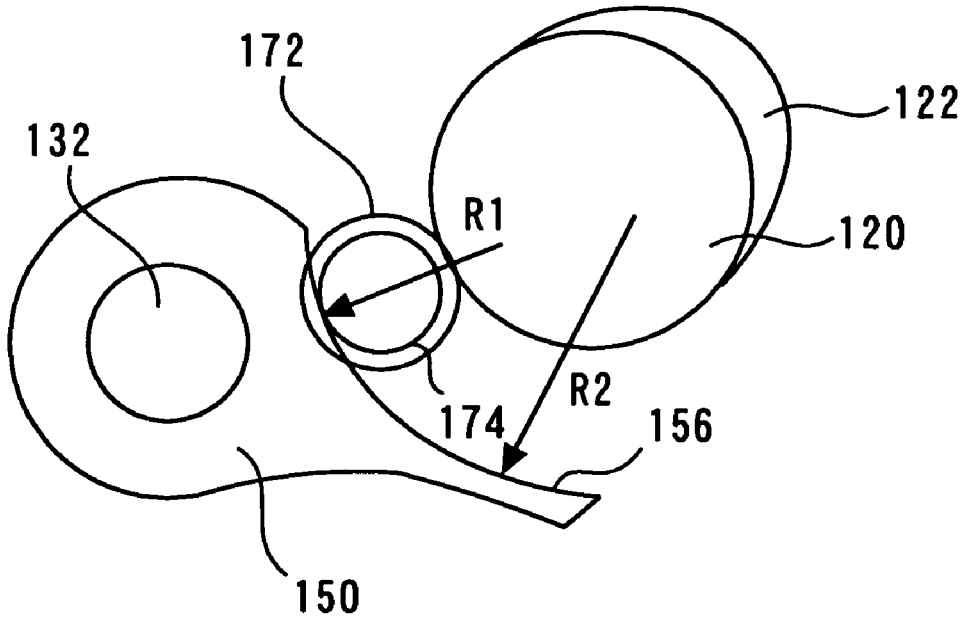
FIG. 5 is an illustration for the explanation about other method for forming the slide surface.

Each arm portion 150 includes the slide surface 156, which contacts the second roller 174, formed on the side thereof opposing the camshaft 120. The slide surface 156 is curved gently toward the side of the drive cam 122. Further, the slide surface 156 is formed so that the distance from the center of the drive come 122 increases from the nearest point from the control shaft 132 toward the farthest point from the control shaft 132 within the area which the second roller 174 contacts. The following two methods, for example, are available as the method for forming the slide surface 156 into the aforementioned shape. Referring to FIG. 4, a first method is to make the center of an arc forming the slide surface 156 away from a cam center from the side of the control shaft 132 toward the side of the leading end with reference to a condition, in which the second roller 174 is the closest to the control shaft 132 (during a large lift amount and a large working angle to be described later). A diameter R of the arc is made constant regardless of the position on the slide surface 156. Referring to FIG. 5, a second method is to enlarge the diameter of the slide surface 156 (the distance from the center of the drive can 122) gradually from the side of the control shaft 132 toward the side of the leading end with reference to a condition, in which the second roller 174 is the closest to the control shaft 132 (during a large lift amount and a large working angle to be described later). For example, referring to two diameters R1, R2 shown in FIG. 5, the diameter R2 is larger than the diameter R1. In addition, whole area of the slide surface 156 does not need to be formed so that the distance from the center of the drive cam 122 increases at greater distances from the center of the control shaft 132. The slide surface 156 may include an area that is formed with a constant distance from the center of the drive cam. In fact, the slide surface 156 should be formed so that the distance from the center of the drive come 122 increases from the nearest point toward the farthest point as a whole.

The arm portion 150 includes a swing cam surface 152 (152*a*, 152*b*) formed on the side opposite to the slide surface 156 thereof. The swing cam surface 152 is a cam surface having the swing center of the first swing cam arm 140 as a cam center. The swing cam surface 152 includes a nonoperating surface 152*a* and an operating surface 152*b* having different profiles from each other. The nonoperating surface 152*a* is disposed on the side of an axis center of the arm portion 150. The nonoperating surface 152*a* is formed with a constant distance kept away from the center of the control shaft 132. The other operating surface 152*b* is disposed on the side of a leading end of the arm portion 150. The operating surface 152*b* is connected to the nonoperating surface 152*a* so as to smoothly continue thereinto. Further, the operating surface 152*b* is formed so that the distance from the center of the control shaft 132 (i.e., a cam height) becomes gradually greater toward the leading end of the arm portion 150. In this specification, the nonoperating surface 152*a* and the operating surface 152*b* will be referred to simply as the swing cam surface 152 when one is not to be differentiated from the other.

Each arm portion 150 also includes a spring seating face 158, to which a lost motion spring not shown is to be hooked. The spring seating face 158 is formed rearward of the nonoperating surface 152*a* in a direction opposite to a direction along which the arm portion 150 extends. The lost motion spring is a compression spring. A pressing force from the lost motion spring acts on the spring seating face 158. The pressing force acting on the spring seating face 158 acts as a force to press the slide surface 156 against the second rollers 174 via the swing cam arm 140. In addition, the u pressing force acting on the spring seating face 158 acts as a force to press the first roller 172 against the drive cam surface 124 via the connecting shaft 176. As a result, the first roller 172 and the second rollers 174 are clamped from both sides by the slide surface 156 and the drive cam surface 124 to be positioned.

A first rocker arm 110 is disposed downward of the first arm portion 150A. The first rocker arm 110 includes a rocker roller 112 disposed so as to oppose the swing cam surface 152. The rocker roller 112 is rotatably mounted at an intermediate portion of the first rocker arm 110. A valve shaft 102 for supporting the valve 104 is mounted on one end of the first rocker arm 110. The other end of the first rocker arm 110 is rotatably supported by a hydraulic lash adjuster 106. The valve shaft 102 is pressed in a closing direction, i.e., a direction of pushing up the first rocker arm 110 by a valve spring not shown. The first rocker arm 110 is supported by the valve shaft 102 that receives the force of the valve spring. The first rocker roller 112 is pressed against the swing cam surface 152 of the first arm portion 150A by the hydraulic lash adjuster 106.

The second swing cam arm 240 is disposed adjacent the side of the second arm portion 150B of the first swing cam arm 140, mounted rotatably on the control shaft 132. The second swing cam arm 240 includes a swing cam surface 252 (252*a*, 252*b*) formed thereon. The swing cam surface 252 is a cam surface having the swing center of the second swing cam arm 240 as a cam center. The swing cam surface 252 includes a nonoperating surface 252*a* and an operating surface 252*b* having different profiles from each other. The swing cam surface 252 of the second swing cam arm 240 is formed to have the same profile as the swing cam surface 152 of the first swing cam arm 140. In this specification, the nonoperating surface 252*a* and the operating surface 252*b* will be referred to simply as the swing cam surface 252 when one is not to be differentiated from the other.

A second rocker arm 210 is disposed downward of the second swing cam arm 240. The second rocker arm 210 includes a rocker roller 212 disposed so as to oppose the swing cam surface 252. The rocker roller 212 is rotatably mounted at an intermediate portion of the second rocker arm 210. A valve shaft 202 for supporting the second valve 204 is mounted on one end of the second rocker arm 210. The other end of the second rocker arm 210 is rotatably supported by a hydraulic lash adjuster not shown. The valve shaft 202 is pressed in a closing direction, i.e., a direction of pushing up the second rocker arm 210 by a valve spring not shown. The second rocker arm 210 is supported by the valve shaft 202 that receives the force of the valve spring. The second rocker roller 212 is pressed against the swing cam surface 252 of the second swing cam arm 240 by the hydraulic lash adjuster.

The second swing cam arm 240 includes a pin hole 256 formed therein. The second arm portion 150B of the first swing cam arm 140 also includes a pin hole 142 formed therein at a position corresponding to position of the pin hole 256. These two pin holes 256, 142 are coupled through a pin 290 to integrate the second swing cam arm 240 with the first swing cam arm 140, allowing the second swing cam arm 240 and the first swing cam arm 140 to be rotated integrally about the control shaft 132.

The non-adjustment mechanism 230 interlocks the rotation motion of the second drive cam 222 with the rocking motion of the second rocker arm 210 through a predetermined relationship. The non-adjustment mechanism 230 includes a lost motion arm (a third swing member) 260, a cam roller 262, and the second swing cam arm 240.

The lost motion arm 260 is disposed adjacent the second swing cam arm 240 so as to sandwich the second swing cam arm 240 between the lost motion arm 260 and the first swing cam arm 140. The lost motion arm 260 is rotatably mounted on the control shaft 132. The second drive cam 222 is disposed so as to oppose the lost motion arm 260.

The lost motion arm 260 includes a pin hole 264 formed therein. The pin hole 264 and the pin hole 256 in the second swing cam arm 240 are coupled through the pin 290 so that the second swing cam arm 240 is integrated with the lost motion arm 260, allowing the second swing cam arm 240 and the lost motion arm 260 to be rocked integrally about the control shaft 132. It is to be noted that the pin 290 is axially driven by, for example, a hydraulic actuator, being selectively inserted in either the pin hole 260 in the lost motion arm 260 or the pin hole 142 in the first swing cam arm 140.

The cam roller 262 is rotatably mounted on the lost motion arm 260. A pressing force from a lost motion spring not shown acts on the lost motion arm 260. The cam roller 262 is pressed against a drive cam surface 224 (224*a*, 224*b*) of the second drive cam 222 by this force. The cam roller 262 is disposed so that, when the lost motion arm 260 is coupled to the second swing cam arm 240, the position of the cam roller 262 relative to the swing cam surface 252 coincides with the position of the first roller 172 relative to the swing cam surface 152 during a large lift amount (the position shown in FIG. 6).

The drive cam surface 124 includes a nonoperating surface 224*a* and an operating surface 224*b*, each having a different profile from each other. The drive cam surface 224 of the second drive cam 222 has the same profiles as the drive cam surface 124 of the first drive cam 122. In this specification, the nonoperating surface 224*a* and the operating surface 224*b* will be referred to simply as the drive cam surface 224 when one is not to be differentiated from the other.

[Operations Performed by the Variable Valve Operating Device According to the First Embodiment]

The operation of the variable valve operating device 100 will be next described with reference to FIGS. 6 through 11.

(1) Valve Lift Operation Performed by the Variable Valve Operating Device

In the variable valve operating device 100, the lift motion of the first valve 104 is interlocked with the rotation motion of the first drive cam 122. The lift operation of the first valve 104 of the variable valve operating device 100 will be described below with reference to FIG. 6. In the figure, (A) shows a condition of the variable valve operating device 100, in which the first valve 104 (omitted in FIG. 6) is closed in a process of the lift operation. (B) shows a condition of the variable valve operating device 100, in which the valve 104 is open in a process of the lift operation.

In the variable valve operating device 100, the rotation motion of the first drive cam 122 is first inputted to the first roller 172 that is in contact with the drive cam surface 124. The first roller 172 rocks about the pin 166 with the second rollers 174 disposed coaxially and integrally. This motion is inputted to the slide surfaces 156 of the swing cam arm 150 that supports the second rollers 164. At this time, there is a difference in speed between the drive cam surface 124 and the slide surfaces 156. Since the two rollers 172, 174 are capable of rotating independently of each other, however, a friction loss during transmission of a driving force is reduced. The slide surfaces 156 are pressed against the second rollers 174 by a pressing force of the lost motion spring (not shown) at all times. Accordingly, the swing cam arm 140 rocks about the control shaft 132 according to the rotation of the drive cam 122 transmitted via the second rollers 164.

More specifically, when the camshaft 120 rotates from the condition shown in FIG. 6(A), a contact position P1 of the first roller 172 on the drive cam surface 124 shifts from the nonoperating surface 124*a* to the operating surface 124*b* as shown in FIG. 6(B). The first roller 172 is relatively pressed downward by the drive cam 122 and the slide surfaces 156 of the swing cam arm 140 are pressed downward by the second rollers 174 integrated with the first roller 172. As a result, the swing cam arm 140 is rotated clockwise in the figure about the control shaft 132. As the camshaft 120 further rotates and the contact position P1 of the first roller 172 on the drive cam surface 124 moves past the vertex portion of the operating surface 124*b*, the swing cam arm 140 this time is rotated counterclockwise in the figure about the control shaft 132 by the pressing force of the lost motion spring and the valve spring.

Rotation of the swing cam arm 140 about the control shaft 132 varies a contact position P3 of the rocker roller 112 on the swing cam surface 152. In the figure, the contact positions of the rocker roller 112 on the swing cam surface 152 are represented by reference characters P3*i* and P3*f*. This is done to differentiate an initial contact position P3*i* from a final contact position P3*f* to be described later. In this specification, the contact position of the rocker roller 112 on the swing cam surface 152 will be generally referred to as the contact position P3.

Referring to FIG. 6(A), if the rocker roller 112 is in contact with the nonoperating surface 152*a*, the distance between the nonoperating surface 152*a* and the center of the control shaft 132 remains constant. Accordingly, there is no change in a special position of the rocker roller 112 regardless of the contact position. The first rocker arm 110 does not therefore rock, thus retaining the first valve 104 at a predetermined position. Positional relationships among the components of the variable valve operating device 100 are adjusted so that the valve 104 is closed when the rocker roller 112 is in contact with the nonoperating surface 152*a*.

Referring to FIG. 6(B), when the contact position P3 of the rocker roller 112 on the swing cam surface 152 changes from the nonoperating surface 152*a* to the operating surface 152*b*, the first rocker arm 110 is pressed downward according to the distance of the operating surface 152*b* from the center of the control shaft 132. The first rocker arm 110 then rocks clockwise about the point of support by the hydraulic lash adjuster 106, whereby the first valve 104 is pressed downward by the first rocker arm 110 and opened.

A reaction force of the valve spring acts from the center of the rocker roller 112 toward the center of the camshaft 120 as the valve 104 makes the lift motion. If, for example, the direction of a line connecting the contact positions P2, P3 of the swing cam arm 140 with other members deviates, at this time, from the direction of action of the reaction force of the valve spring, the swing cam arm 140 transmits force as a beam element. Flexural rigidity must, however, be secured for the transmission of force by the beam element. If the variable valve operating device 100 is operated at high speed in a condition, in which rigidity is not sufficiently secured, flexure occurs in the swing cam arm 140 due to inertial force. Flexure in the swing cam arm 140 invites such problems as bounce of the valve 104 due to early seating, a reduced lift amount during opening of the valve 104, and valve closing failure. There is also a likelihood that the valve 104 will be damaged by an impact load caused by bounce upon seating of the valve 104 or wear in bearings will be promoted due to a moment load produced by the beam element. Moreover, a necessity may arise to thicken the swing cam arm 140 for achieving rigidity of the beam element, which could result in increased weight. An increase in weight increases friction within the driving force transmission system, aggravating fuel economy.

Figure 6:
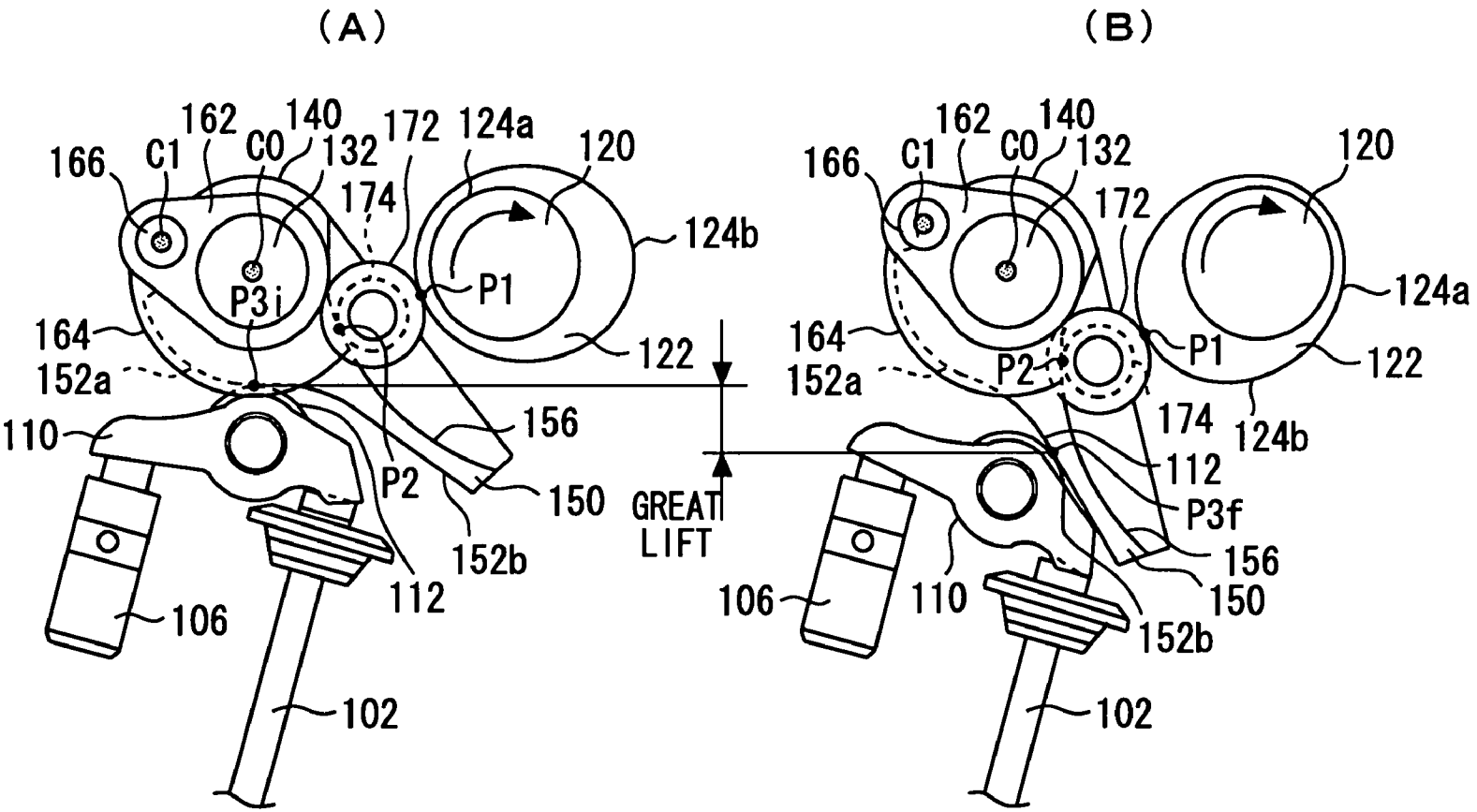
FIG. 6 illustrates a great lift operation performed by the variable valve operating device according to the first embodiment of the present invention, in the figure, (A) shows a valve open condition and (B) shows valve closed condition.

FIG. 6 shows a condition, in which the variable valve operating device 100 operates so as to give the first valve 104 the maximum lift. FIG. 6(B) is a view showing positional relationships among individual members during the maximum lift. The reaction force of the valve spring becomes the greatest at the maximum lift shown in FIG. 6(B). As shown in this figure, individual members of the variable valve operating device 100 are designed so that the contact position P1 of the first roller 172 on the drive cam surface 124, the contact position P2 of the second roller 174 on the slide surface 156, and the contact position P3 of the rocker roller 112 on the swing cam surface 152 are substantially aligned on a straight line (a line of action of the reaction force of the valve spring) connecting the center of the camshaft 120 and the center of the rocker roller 112 during the maximum lift. As such, the contact positions P1, P2, and P3 between the corresponding pairs of individual members are substantially aligned with the line of action of the reaction force of the valve spring. This arrangement eliminates transmission of force by the beam element among individual members, helping enhance rigidity of the entire device.

Referring to FIG. 6(A), in the variable valve operating device 100, the position of rocking center (pin 166) of the link arms 164 is adjusted so that the contact positions P1, P2, and P3 between the corresponding pairs of individual members do not widely deviate from the straight line connecting the center of the camshaft 120 and the center of the rocker roller 112 even when the valve 104 is closed. This allows the driving force to be efficiently transmitted from the camshaft 120 to the rocker roller 112 at all times during a period of time from the start of lift to the maximum lift of the valve 104.

Figure 7:
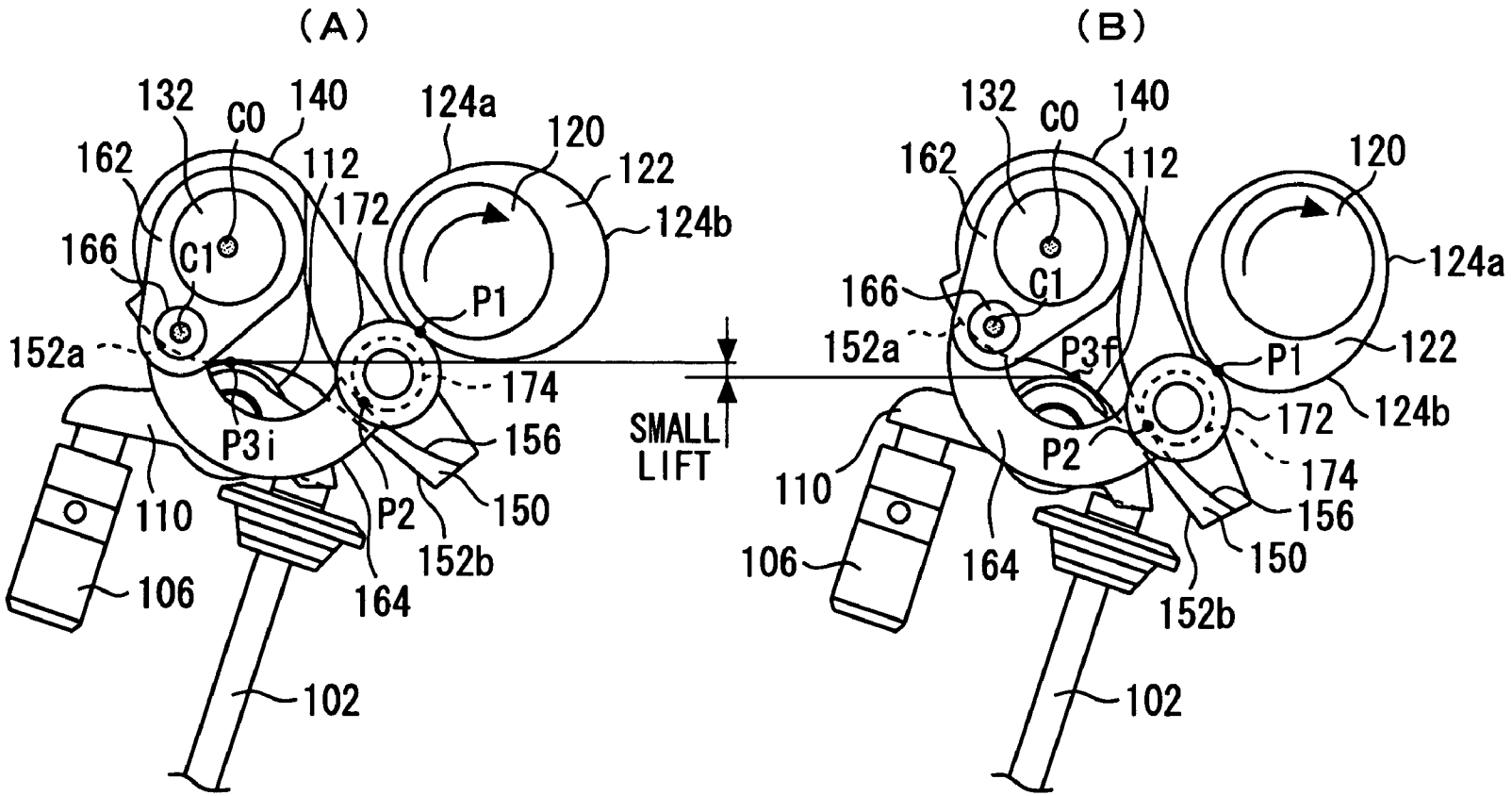
FIG. 7 illustrates a small lift operation performed by the variable valve operating device according to the first embodiment of the present invention, in the figure, (A) shows a valve open condition and (B) shows valve closed condition.

(2) Valve Lift Amount Change Operation Performed by the Variable Valve Operating Device The operation for changing valve lift amount of the first valve 104 (see FIG. 1; omitted in the figure) of the variable valve operating device 100 will be next described with reference to FIGS. 6 and 7. FIG. 7 shows a condition, in which the variable valve operating device 100 operates so as to give the first valve 104 a small lift. As described above, FIG. 6 shows a condition, in which the variable valve operating device 100 operates so as to give the first valve 104 the maximum lift. In each of the figures, (A) shows a condition of the variable valve operating device 100, in which the valve 104 is closed in a process of the lift operation. (B) shows a condition of the variable valve operating device 100, in which the valve 104 is open in a process of the lift operation.

When the valve lift amount is changed from the valve lift amount shown in FIG. 6 to the valve lift amount shown in FIG. 7, the control shaft 132 is rotatably driven in the condition shown in FIG. 6(A), thereby rotatably moving a position C1 of the pin 166 to the position shown in FIG. 7(A). The link arms 164 hold the first roller 172 and the second rollers 174 at corresponding positions a predetermined distance away from the position C1 of the pin 166. Accordingly, as the position C1 of the pin 166 moves, the second rollers 174 move along the slide surfaces 256 in a direction of being away from the control shaft 132 from the position shown in FIG. 6(A) to the position shown in FIG. 7(A). At the same time, the first roller 172 moves to an upstream side in the direction of rotation thereof along the drive cam surface 124.

Figure 8:
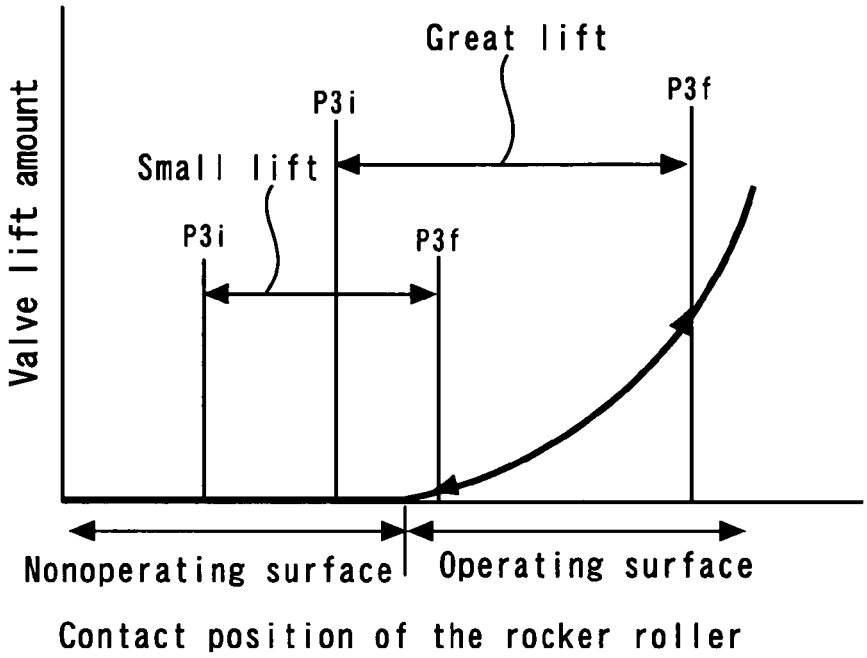
FIG. 8 is a graph showing the relationship between the contact position of the rocker roller onto the swing cam surface and the valve lift amount in the variable valve operating device according to the first embodiment of the present invention.

The movement of the second rollers 174 moving in the direction of being away from the control shaft 132 makes longer the distance between a swing center C0 of the swing cam arm 140 and the contact position P2 of the second rollers 174 on the slide surfaces 156. This decreases a swing angle of the swing cam arm 140. This is because the swing angle of the swing cam arm 140 is inversely proportional to the distance between the swing center C0 and the input point of oscillation. Referring to (B) in each figure, the lift amount of the first valve 104 becomes the greatest when the contact position P1 of the first roller 172 on the drive cam surface 124 is located at the vertex portion of the operating surface 124*b*. The valve lift amount of the first valve 104 is determined by the contact position P3*f* (hereinafter referred to as the final contact position) of the rocker roller 112 on the swing cam surface 152 at that particular point in time. FIG. 8 is a diagram showing the relationship between the position of the rocker roller 112 on the swing cam surface 152 and the valve lift amount. As shown in this figure, the final contact position P3*f* is determined by the swing angle of the swing cam arm 140 and the contact position P3*i* (hereinafter referred to as the initial contact position) of the rocker roller 112 on the swing cam surface 152 shown in (A) of each figure.

In the variable valve operating device 100 according to this embodiment, the slide surfaces 156 are formed so that the greater the distance thereof from the swing center C0, the greater the distance from the cam base circle (nonoperating surface 124*a*) of the drive cam 122. Accordingly, the farther the aforementioned contact position P2 moves away from the swing center C0 of the swing cam arm 140, the more the swing cam arm 140 is inclined in a direction in which the slide surfaces 156 approach the drive cam surface 124. In the figure, the swing cam arm 140 rotates counterclockwise about the control shaft 132. As shown in FIG. 7(A), the initial contact position P3*i* of the rocker roller 112 on the swing cam surface 152 moves in the direction of being away from the operating surface 152*b*.

By rotating the control shaft 132 as described above, the swing angle of the swing cam arm 140 decreases and the initial contact position P3*i* moves in the direction of being away from the operating surface 152*b*. As a result, the final contact position P3*f* to be reached by the rocker roller 112 moves on the side of the nonoperating surface 152*a* as shown in FIG. 8. This decreases the valve lift amount of the valve 104. The period (crank angle) through which the rocker roller 112 remains located on the nonoperating surface 152*a* is the working angle of the valve 104; however, movement of the final contact position P3*f* onto the side of the nonoperating surface 152*a* decreases the working angle of the valve 104 also. Further, movement of the first roller 172 to the upstream side in the direction of rotation of the camshaft 120 causes the contact position P1 of the first roller 172 on the drive cam surface 124 when the camshaft 120 is at the same rotation position to move toward an advance side of the drive cam 122. This advances swing timing of the swing cam arm 140 relative to the phase of the camshaft 120, which results in valve timing (maximum lift timing) being advanced.

Figure 9:
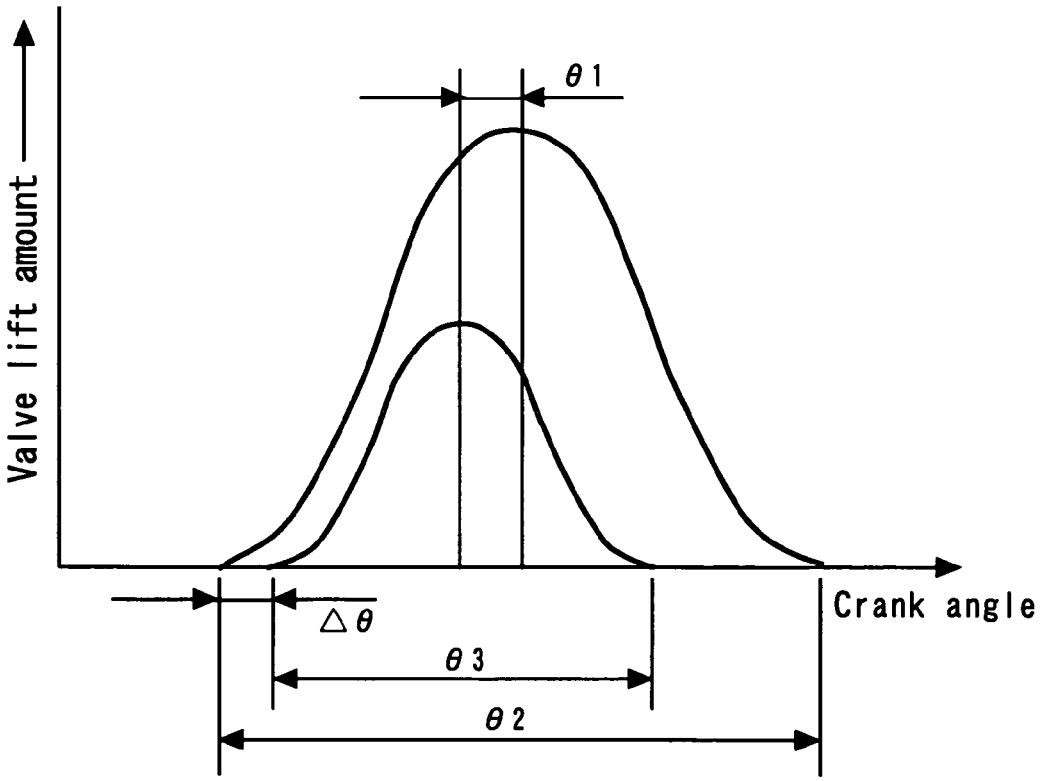
FIG. 9 is a graph showing the relationship between the valve lift amount and valve timing of the valve achieved by the variable valve operating device according to the first embodiment of the present invention.

FIG. 9 is a graph showing the relationship between the valve lift amount and valve timing of the valve 104 achieved by the variable valve operating device 100. As shown in this figure, according to the variable valve operating device 100, valve timing can be retarded, while at the same time the working angle can be increased in association with the increase in the valve lift amount of the valve 104. According to the variable valve operating device 100, on the other hand, the valve timing can be advanced, while at the same time the working angle can be decreased in association with the decrease in the valve lift amount of the valve 104. It should be noted that, as shown in FIG. 9, the opening timing of the valve 104 is determined by the valve timing and working angle. Referring to FIG. 9, the working angle decreases from θ2 to θ3 in accordance with the decrease in the valve lift amount from the maximum lift. An amount of retard Δθ of the opening timing of the valve 104 when the valve timing advances by θ1 is given by the following equation (1):

$$\Delta\theta=(\theta 2-\theta 3)/2-\theta 1 \quad (1)$$

Figure 10:
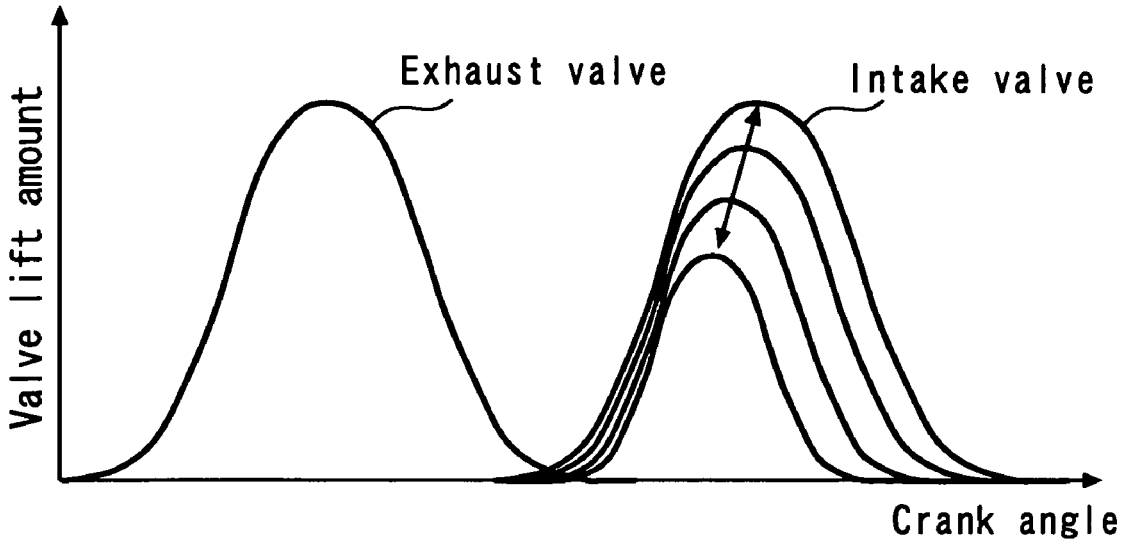
FIG. 10 is a graph showing an example of the valve timing-lift characteristic realizable by the variable valve operating device according to the first embodiment of the present invention.
Figure 11:
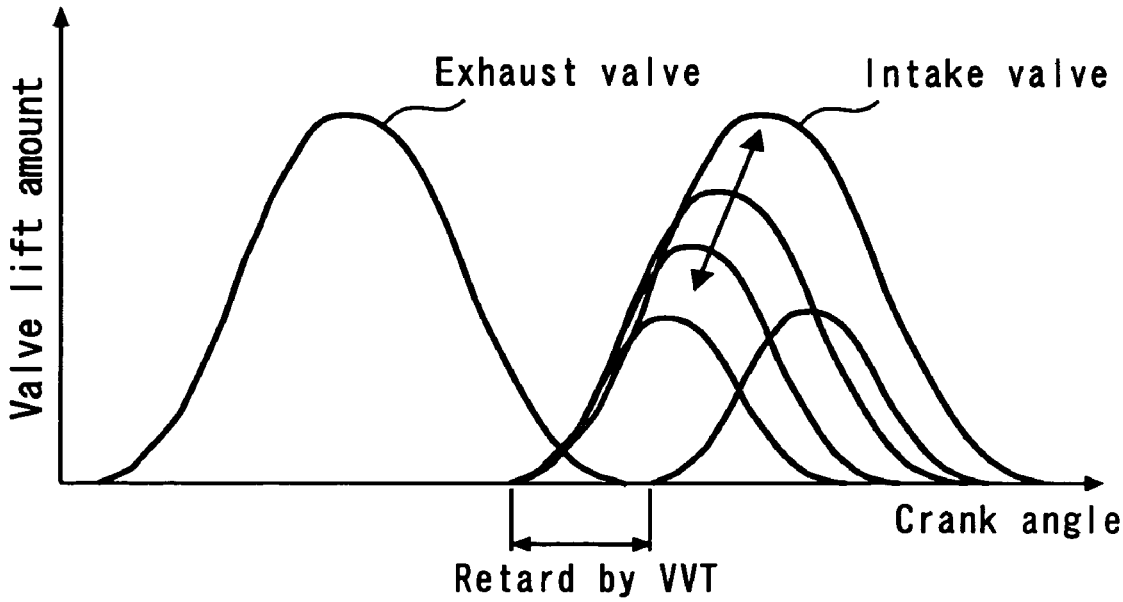
FIG. 11 is a graph showing other example of the valve timing-lift characteristic realizable by the variable valve operating device according to the first embodiment of the present invention.

As shown in equation (1) above, the amount of retard Δθ of the opening timing of the valve 104 with reference to the opening timing at the maximum lift can be adjusted by appropriately setting the amount of change in the working angle and the amount of change in the valve timing. Accordingly, assuming, for example, that the valve 104 is an intake valve, it is appropriate, as shown in FIG. 10, that the opening timing be advanced more to increase an overlap with an exhaust valve at larger lift amount and larger working angle. It is also appropriate that opening timing be retarded more to decrease the overlap with the exhaust valve at smaller lift amount and smaller working angle. Referring further to FIG. 11, it is still appropriate that the opening timing be made constant regardless of the valve lift amount or the working angle.

It is preferred to use the valve timing-lift characteristic shown in FIG. 10 for control of intake valves of gasoline engines. In gasoline engines, there is a need for advancing the opening timing at large lift and large working angle that are frequently used at high speeds. This represents a need for a large overlap during high speed operations in order to improve charge efficiency through dynamic effects, such as intake inertia effect and exhaust pulsation. The opening timing is to be retarded, on the other hand, at smaller lift and smaller working angle used at low speeds. This is because, at low speeds, the presence of the overlap increases residual gas, which decreases the charge efficiency. The variable valve operating device 100 according to the embodiment is able to achieve the valve timing-lift characteristic as shown in FIG. 10 without having to use a valve timing control mechanism, such as VVT or the like. Specifically, the amount of advance θ1 of the valve timing is set to a value smaller than ½ of the amount of change in the working angle (θ2-θ3).

It is preferred to use the valve timing-lift characteristic shown in FIG. 11 for control of intake valves of diesel engines. Where a compact combustion chamber having a high compression ratio is necessary, a piston cannot be provided with a valve recess. Accordingly, in order to meet the need for avoiding a likelihood of piston stamp, diesel engines involves a need for keeping the opening timing constant at all times regardless of the valve lift amount or the working angle. The variable valve operating device 100 according to the embodiment is able to achieve the valve timing-lift characteristic as shown in FIG. 11. Specifically, the amount of advance θ1 of the valve timing is set to ½ of the amount of change in the working angle (θ2-θ3). It is to be noted that, in addition to the aforementioned need, there is another need for retarding the opening timing in order to improve startability during cold starting. This is because a negative pressure inside cylinders can be used to increase an intake flow velocity and an energy produced therefrom can be used to increase temperature. If a valve timing control mechanism, such as the VVT or the like, is provided in addition to the variable valve operating device 100, therefore, the valve timing control mechanism may be used to retard the valve timing most during starting as shown in FIG. 11.

(3) Interlock Selecting Operation Performed by the Variable Valve Operating Device The operative interlock selecting operation of a second valve 204 in the variable valve operating device 100 will be next described with reference to FIG. 3.

The part with which the lift motion of the second valve 204 is interlocked can be selectively changed between the first drive cam 122 and the second drive cam 222 by selecting a part into which the pin 290 is inserted. In accordance with the embodiment, interlock selecting means is formed from the pin 290, each of the pin holes 142, 464, and an actuator not shown for driving the pin 290.

When the pin 290 is inserted in the pin hole 142 in the first swing cam arm 140, the second swing cam arm 240 is interlocked with the first swing cam arm 140. The lift motion of the second valve 204 is then associated with the rotation motion of the first drive cam 122 in the same manner as with the lift motion of the first valve 104. The swing cam surface 252 of the second swing cam arm 240 has the same cam profile as that of the swing cam surface 152 of the first swing cam arm 140. Accordingly, the second valve 204 makes the lift motion with the same operating characteristic as those of the first valve 104.

In this case, the second valve 204 has a variable operating characteristic. Varying the rotation position of the control shaft 132 varies the contact position P2 of the second rollers 174 on the slide surfaces 156 and the contact position P1 of the first roller 172 on the drive cam surface 124 simultaneously. Thus, the valve lift amount of the second valve 204 varies in association with the valve timing.

When the part in which the pin 290 is inserted is changed from the pin hole 142 in the first swing cam arm 140 to the pin hole 464 in the lost motion arm 260, on the other hand, the second swing cam arm 240 is interlocked with the lost motion arm 260. The lift motion of the second valve 204 is then associated with the rotation motion of the second drive cam 222. The position of the cam roller 262 relative to the swing cam surface 252 is equal to the position of the first roller 172 relative to the swing cam surface 152 during a large lift. The second valve 204 therefore makes the lift motion with the operating characteristic of the first valve 104 during the large lift.

In this case, whereas the operating characteristic of the first valve 104 is variable and the valve lift amount can be varied, the operating characteristic of the second valve 204 is fixed with a constant valve lift amount. Accordingly, if the first valve 104 and the second valve 204 are intake valves of the same cylinder, changing the valve lift amount of the first valve 104 to thereby control a difference in the valve lift amount between the two valves 104, 204 allows the flow of a mixture inside the cylinder to be controlled (swirl control). It is also possible to let only the second valve 204 draw the mixture with the lift motion of the first valve 104 suspended, if the valve lift amount of the first valve 104 during a small lift is set to zero.

[Advantages of the Variable Valve Operating Device According to the First Embodiment]

As described in the foregoing, according to the variable valve operating device 100 of this embodiment, the control shaft 132 is rotatably driven to vary the rotation position of the control cam 134, thereby changing the contact position P2 of the second rollers 174 on the slide surfaces and the contact position P1 of the first roller 172 on the drive cam surface 124. This, in turn, allows the valve lift amount, working angle, and valve timing of the valve 104 to be varied in association with one another.

Figure 12:
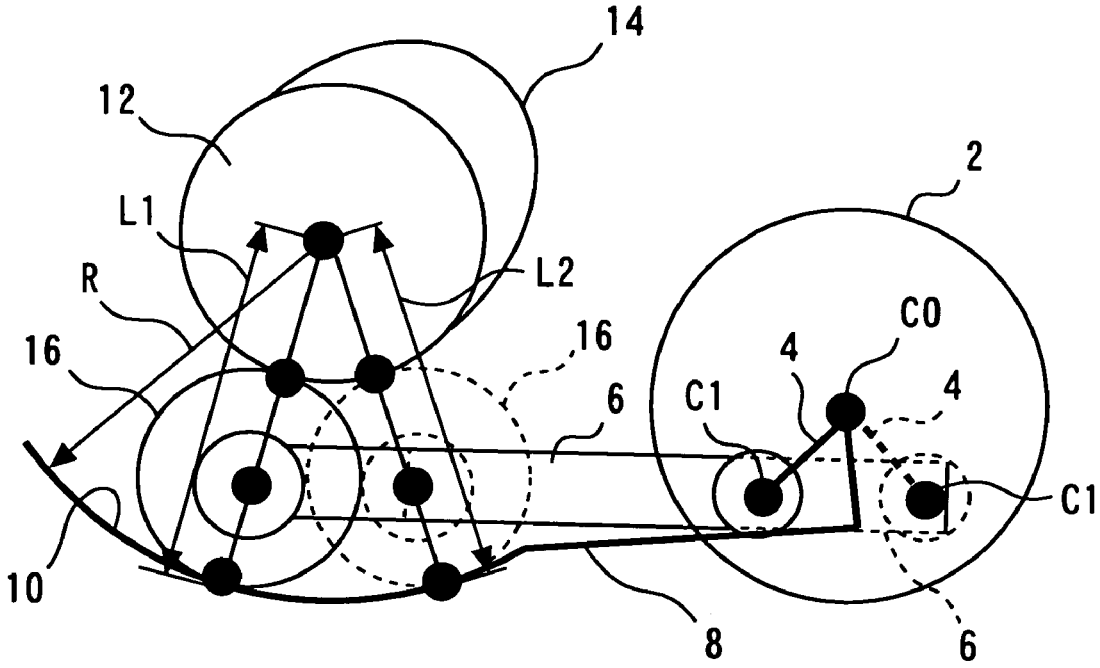
FIG. 12 is a view showing schematically the adjustment mechanism of the variable valve operating device according to the first embodiment of the present invention.
Figure 13:
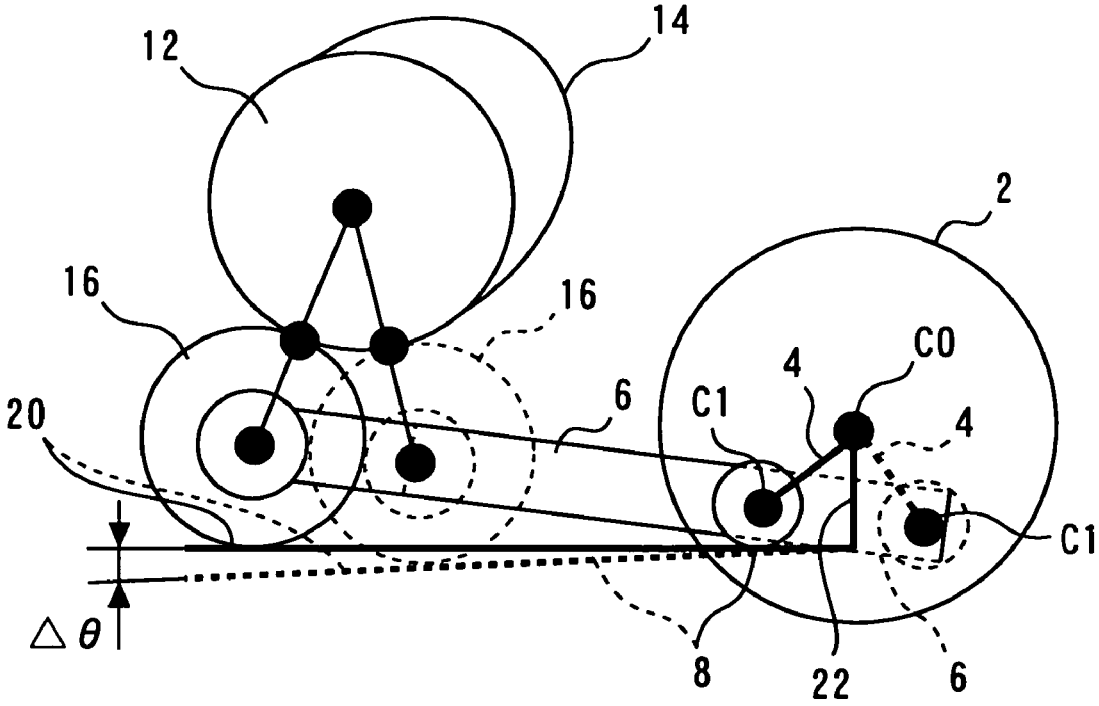
FIG. 13 is a view showing schematically the adjustment mechanism of the conventional variable valve operating device.

In this case, forming the slide surfaces 156 into a curve helps suppress an initial swing position of the swing cam arm 140 from changing excessively relative to the change in the position of the first roller 172 on the drive cam surface 124. FIGS. 12 through 15 are explanatory views for illustrating, for better understanding, advantages of the variable valve operating device 100 according to this embodiment, in particular, advantages of forming the slide surfaces 156 into a curve. FIG. 12 is a view showing schematically the adjustment mechanism of the variable valve operating device 100 according to this embodiment. FIG. 13 is a view showing schematically the adjustment mechanism of the conventional variable valve operating device. Parts used in common with the two mechanisms are identified by the same reference numerals. In each of these mechanisms, a control shaft 2 is disposed in a fixed position relative to, and extending in parallel with, a camshaft 12 that includes a drive cam surface 14 formed thereon. The control shaft 2 includes a control member 4 that rotates with the control shaft 2 fixed thereto and a swing member 8 mounted rockably thereon. The swing member 8 includes a slide surface 10 or 20 formed on a side thereof opposing the camshaft 12. In the mechanism shown in FIG. 12, the slide surface 10 is a curved surface curving in the direction of rotation of the camshaft 12. In the mechanism shown in FIG. 13, on the other hand, the slide surface 20 is a flat surface.

An intermediate roller (intermediate member) 16 is disposed between the slide surface 10 or 20 and the drive cam surface 14. The intermediate roller 16 is in contact with both the slide surface 10 or 20 and the drive cam surface 14. The intermediate roller 16 is positioned by a connecting member 6. A rocking center C1 of the connecting member 6 is positioned at a position that is eccentric away from a center C0 of the control shaft 2 by the control member 4. The connecting member 6 maintains a predetermined distance for the intermediate roller 16 away from the rocking center C1.

The camshaft 120 of the variable valve operating device 100 according to this embodiment corresponds to the camshaft 12 of the mechanism shown in FIG. 12. Similarly, the drive cam surface 124 of the drive cam 122 corresponds to the drive cam surface 14. Similarly, the control shaft 132 corresponds to the control shaft 12 and the control arm 162 corresponds to the control member 4. Similarly, the swing cam arm 140 corresponds to the swing member 8 and the slide surfaces 156 correspond to the slide surface 10. Similarly, the first roller 162 and the second rollers 164 correspond to the intermediate roller 16 and the link arms 164 correspond to the connecting member 6.

In the mechanisms as shown in FIGS. 12 and 13, the control shaft 2 is driven to rotatably move the control member 4 from a position shown in a solid line to a position shown in a broken line. The rotation motion of the control member 4 causes the rocking center C1 of the connecting member 6 positioned by the control member 4 to make a rotation motion around the control shaft 2. The intermediate roller 16 is sandwiched between the drive cam surface 14 and the slide surface 10 or 20. Further, the connecting member 6 maintains a predetermined distance for the intermediate roller 16 away from the rocking center C1. As a result, the intermediate roller 16 moves, in accordance with the movement of the rocking center C1, from the position shown in the solid line to the position shown in the broken line between the slide surface 10 and the drive cam surface 14. The position of the intermediate roller 16 on the slide surface 10 or 20 and the position on the drive cam surface 14 when the camshaft 12 is at the same rotation position are varied in association with each other.

At this time, the intermediate roller 16 moves while its being sandwiched between the drive cam surface 14 and the slide surface 10 or 20. Accordingly, depending on the relationship between the movement trajectory of the intermediate roller 16 and the position at which the slide surface 10 or 20 is located, the position of the slide surface 10 or 20 varies in accordance with the movement trajectory of the intermediate roller 16. This produces a change in an initial inclination angle of the swing member 8.

In the mechanism shown in FIG. 13, while the movement trajectory of the intermediate roller 16 is circularly arcuate along the drive cam surface 14, the slide surface 20 is a flat surface. The position at which the slide surface 20 is located does not coincide with the movement trajectory of the intermediate roller 16, causing the position of the slide surface 20 to be changed largely to match the movement trajectory of the intermediate roller 16. Accordingly, as shown by the broken line in FIG. 7, a change $\Delta\theta$ is produced in the initial inclination angle of the swing member 8. As a result, a large change is produced in the valve lift amount of the valve.

In the mechanism as shown in FIG. 12, on the other hand, the slide surface 10 is formed into a curved surface curved in the direction of rotation of the camshaft 12. As compared with the flatly shaped slide surface 20 of FIG. 13, there is a smaller deviation between the movement trajectory of the intermediate roller 16 and the position at which the slide surface 10 is located. FIG. 12 shows a special case, in which the slide surface 10 forms an arc that is concentric with the camshaft 12. In this case, the movement trajectory of the intermediate roller 16 coincides with the position at which the slide surface 10 is located. This eliminates any change in the position of the slide surface 10 that may otherwise be produced as the intermediate roller 16 moves. Accordingly, the initial inclination angle of the swing member 8 is maintained at a predetermined position, thus preventing the valve lift amount of the valve from being changed by a change in the initial inclination angle.

Figure 14:
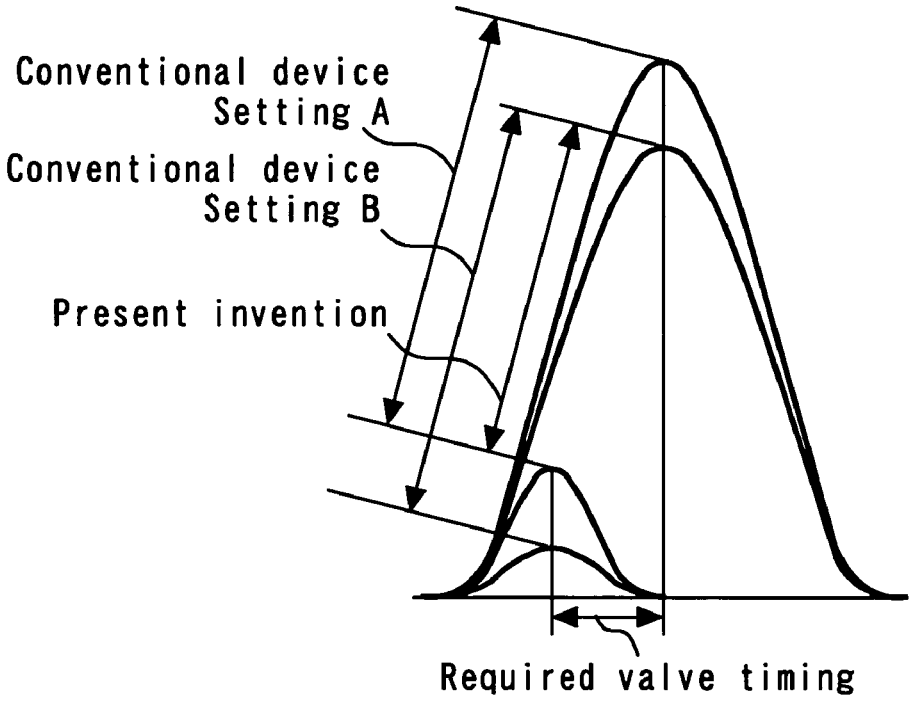
FIG. 14 is an illustration for the explanation about the advantages of the variable valve operating device according to the first embodiment of the present invention over the conventional variable valve operating device.

FIG. 14 is a diagram that compares the amount of change in the valve lift amount with respect to the amount of change in the required valve timing between the variable valve operating device 100 according to this embodiment and the conventional variable valve operating device. As shown in this figure, if the valve lift amount at the small lift is made to be the same, the valve lift amount at the large lift becomes excessively large (setting A) in the conventional variable valve operating device. If the valve lift amount at the large lift is made to be the same, on the other hand, the valve lift amount at the small lift becomes excessively small (setting B) in the conventional variable valve operating device. As is known from this figure, according to the variable valve operating device 100 of the embodiment, the amount of change in the valve lift amount can be prevented from becoming excessively large with respect to the amount of change in the required valve timing.

Figure 15:
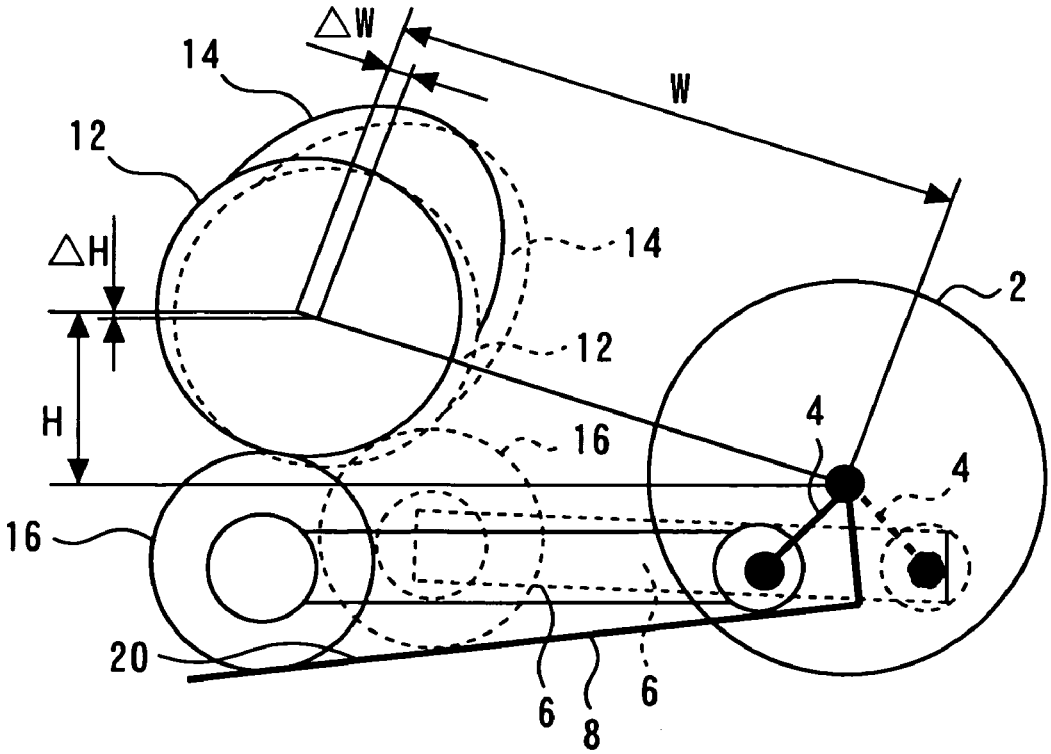
FIG. 15 is an illustration for the explanation about the problem of the conventional variable valve operating device.

It should be noted, however, that, even with the conventional variable valve operating device, the amount of change in the valve lift amount can be prevented from becoming excessively large, if the positional relationship between the camshaft 12 and the control shaft 2 is adjusted. More specifically, referring to FIG. 15, the position of the intermediate roller 16 at the large lift (the position indicated by the broken line) is established in accordance with the position of the slide surface 20 at the small lift so as to make sure that there is no change in the initial inclination angle of the swing member 8 between that at the small lift and that at the large lift. The position of the camshaft 12 is then determined accordingly. FIG. 15 compares the position of the camshaft 12 (the position indicated by the solid line) established through the foregoing positional adjustments against the position of the camshaft 12 (the position indicated by the broken line) corresponding to the variable valve operating device 100 according to this embodiment.

Following are, however, known from the comparison made of the two positions of the camshaft 12 shown in FIG. 5. Specifically, in the conventional variable valve operating device, even if the amount of change in the valve lift amount can be prevented from becoming excessively large, a distance W between the camshaft 12 and the control shaft 2 is enlarged and a height H of the camshaft 12 is enlarged. Specifically, there is an increase in size of the device. In this respect, according to the variable valve operating device 100 of the embodiment, the amount of change in the valve lift amount can be prevented from becoming excessively large, thereby achieving desired operating characteristic without inviting an increase in size of the device.

As described heretofore, in accordance with the variable valve operating device 100 of this embodiment, an excessive change in the valve lift amount can be suppressed with respect to changes in the valve timing. As a result, an ideal valve timing-lift characteristic as shown in FIG. 10 or 11 can be realized without using in combination the variable valve timing mechanism, such as the VVT or the like, or without having to let the variable valve timing mechanism, should one be used in combination, operate largely.

In addition, in accordance with the variable valve operating device 100 of this embodiment, the part with which the lift motion of the second valve 204 is interlocked can be selectively changed between the first drive cam 122 and the second drive cam 222 by selecting the part into which the pin 290 is inserted. If the lift motion of the second valve 204 is to be interlocked with the first drive cam 122, the operating characteristic of the second valve 204 can be made to coincide with those of the first valve 104. It is then possible to vary both the valve lift amount and valve timing of the second valve 204 in association with each other in the same manner as with the first valve 104. If the lift motion of the second valve 204 is to be interlocked with the second drive cam 222, it becomes possible to perform swirl control or valve pause by controlling the difference in the valve lift amount between the two valves 104, 204 with the operating characteristic of the second valve 204 fixed.

Second Embodiment

A second embodiment of the present invention will be described below with reference to FIGS. 16 through 19.

[Configuration of the Variable Valve Operating Device According to the Second Embodiment]

Figure 16:
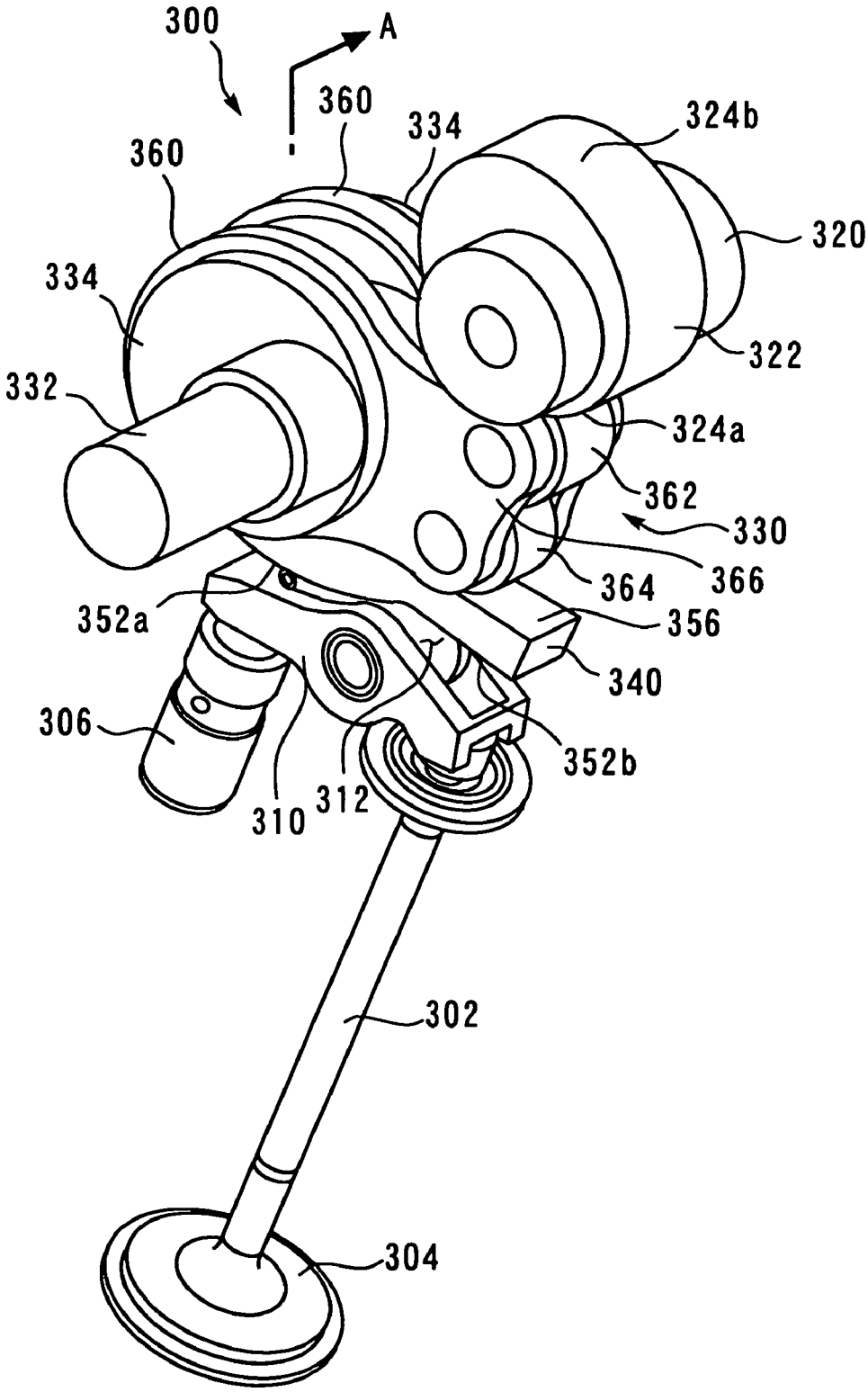
FIG. 16 is a perspective view showing the configuration of a variable valve operating device according to the second embodiment of the present invention.
Figure 17:
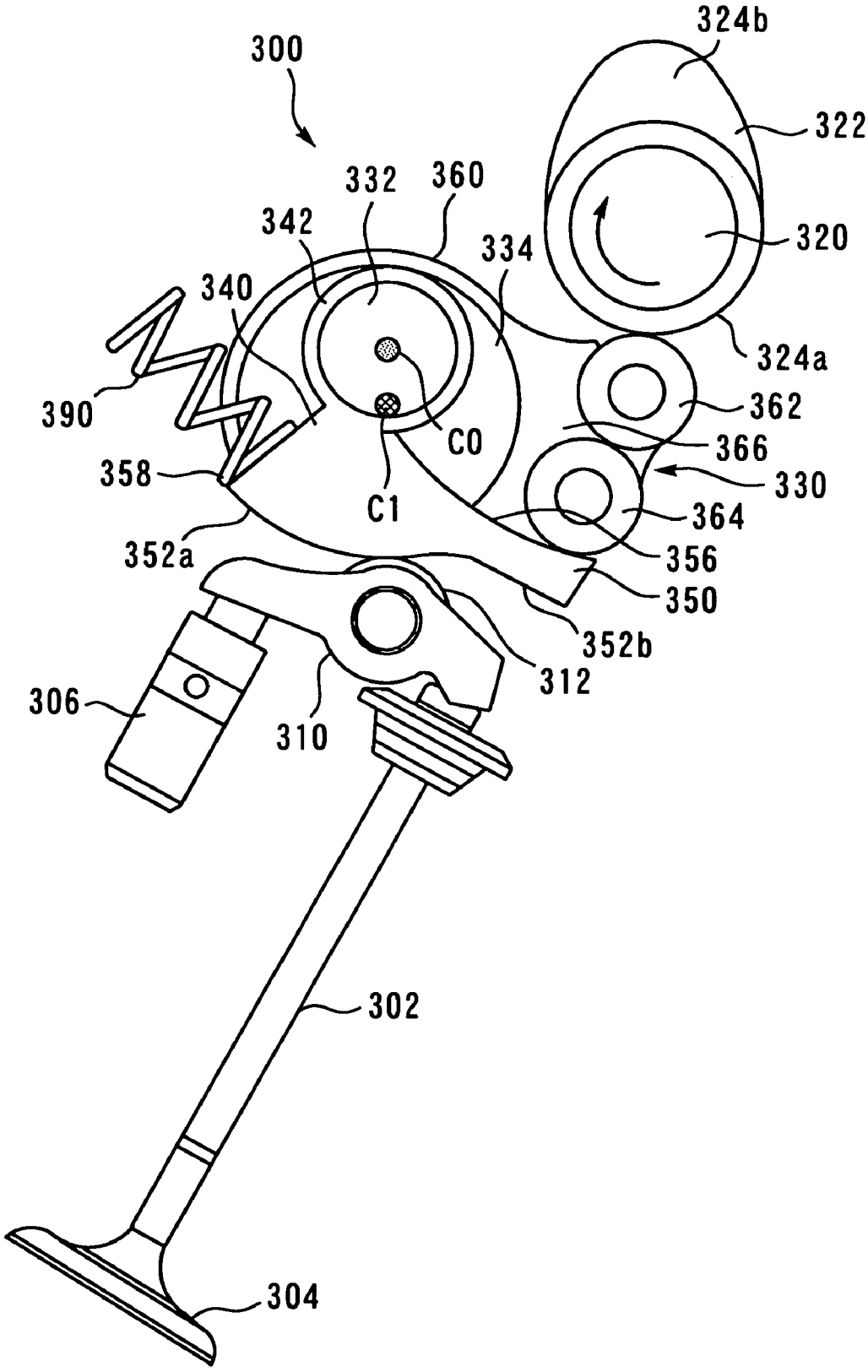
FIG. 17 is a side elevational view seen in the direction of A in FIG. 16.

FIG. 16 is a perspective view showing the configuration of a variable valve operating device 300 according to the second embodiment of the present invention. FIG. 17 is a side elevational view seen in the direction of A in FIG. 16. This variable valve operating device 300 includes a mechanical valve operating mechanism of a rocker arm type. Rotation motion of a camshaft 320 is converted to a rocking motion of a rocker arm (valve supporting member) 310 by a drive cam 322 disposed on the camshaft 320. This is, in turn, converted to a lift motion in the vertical direction of a valve 304 supported by the rocker arm 310.

As in the first embodiment, the variable valve operating device 300 has an adjustment mechanism 330 interposed between the drive cam 322 and the rocker arm 310. The adjustment mechanism 330 interlocks the rocking motion of the rocker arm 310 with the rotation motion of the drive cam 322. The adjustment mechanism 330 includes, as major component members thereof, a control shaft 332, an eccentric disc 334, a swing cam arm 340, an eccentric arm 360, a first roller 362, and a second roller 364, as will be described below. The control shaft 332 is disposed to extend in parallel with, and be fixed relative to, the camshaft 320. An actuator not shown (e.g., a motor) is connected to the control shaft 332. An ECU of an internal combustion engine is able to adjust the rotation position of the control shaft 332 to any arbitrary value by controlling the actuator.

The eccentric disc 334 is integrally secured to the control shaft 332 with a center C1 thereof mounted eccentrically with respect to a center C0 of the control shaft 332. The eccentric arm 360 is mounted on an outer periphery of the eccentric disc 334. The eccentric arm 360 is a rotational body freely rotatable around the eccentric disc 334. A set of the eccentric disc 334 and the eccentric arm 360 is arranged in pairs, each pair being spaced apart from each other in an axial direction of the control shaft 332. (In FIG. 17, the eccentric disc 334 and the eccentric arm 360 on the rear side only are shown with the eccentric shaft and the eccentric shaft arm on the front side omitted.)

The first roller 362 and the second roller 364 are disposed between the right and left eccentric arms 360, 360. The eccentric arm 360 has an arm portion 366 extending in a diametric direction of the eccentric disc 334. The right and left arm portions 366 rotatably support both shaft ends of each of these two rollers 362, 364. This allows the two rollers 362, 364 to rock around the eccentric disc 334, while maintaining a predetermined distance away from a center of the eccentric disc 334. The two rollers 362, 364 are disposed in a row substantially in a circumferential direction of the eccentric disc 334. The first roller 362 disposed upward abuts on a drive cam surface 324 (324*a*, 324*b*) of the drive cam 322. The second roller 364 disposed downward abuts on a slide surface 356 of the swing cam arm 340 to be described later.

The drive cam surface 324 includes two cam surfaces having different profiles from each other. One of the two cam surfaces, a nonoperating surface 324*a*, is formed to keep a predetermined distance from the center of the camshaft 320. The other of the two cam surfaces, an operating surface 324*b*, is formed so that the distance from the center of the camshaft 320 gradually grows larger and, after a vertex portion, gradually grows smaller. In this specification, the nonoperating surface 324*a* and the operating surface 324*b* will be referred to simply as the drive cam surface 324 when one is not to be differentiated from the other.

The swing cam arm 340 is disposed between the two eccentric discs 334. The swing cam arm 340 includes a bearing portion 342 and a cam portion 350. The bearing portion 342 is rotatably mounted on an outer periphery of the control shaft 332. The cam portion 350 hangs onto the bearing portion 342. The cam portion 350 is integrally joined to the bearing portion 342. The cam portion 350 includes three main faces: a swing cam surface 352 (352*a*, 352*b*), the slide surface 356, and a spring seating face 358.

Of the three faces included in the cam portion 350, the slide surface 356 and the spring seating face 358 are formed so as to extend from the bearing portion 342. The slide surface 356 is formed on the side opposing the drive cam 322. The spring seating face 358 is formed on the opposite side. The slide surface 356 is curved gently toward the side of the drive cam 322. Further, the slide surface 356 is formed so that the distance from a cam base circle (nonoperating surface 324*a*) of the drive cam 322 increases at greater distances from the center of the control shaft 132 that serves as the swing center. As described earlier, the first roller 362 and the second roller 364 are disposed between the slide surface 356 and the drive cam surface 324. A proximal end of a lost motion spring 390, a leading end of which is secured within a space, is hooked onto the spring seating face 358. The lost motion spring 390 is a compression spring. An pressing force from the lost motion spring 390 acts on the spring seating face 358.

The pressing force acting on the spring seating face 358 acts as a force to press the slide surface 356 up against the second roller 364 via the swing cam arm 340. In addition, the pressing force acting on the spring seating face 358 also acts as a force to press the first roller 362 up against the drive cam surface 324 via the eccentric arm 360. As a result, the first roller 362 and the second roller 364 are clamped from both sides by the slide surface 356 and the drive cam surface 324 and thus positioned.

The swing cam surface 352 is formed so as to connect a leading end of the slide surface 356 and a leading end of the spring seating face 358. The swing cam surface 352 is a cam surface having the swing center of the swing cam arm 340 as a cam center. The swing cam surface 352 includes a nonoperating surface 352*a* and an operating surface 352*b* having different profiles from each other. The nonoperating surface 352*a* is a peripheral surface of a cam base circle, formed with a constant distance from the center C0 of the control shaft 332. The other operating surface 352*b* is disposed in the direction of rotation of the swing cam arm 340 as caused by a pressing force of the lost motion spring 390 as viewed from the nonoperating surface 352*a* (counterclockwise about the control shaft 332 in FIG. 17). The operating surface 352*b* is connected to the nonoperating surface 352*a* so as to smoothly continue thereinto. Further, the operating surface 352*b* is formed so that the distance from the center C0 of the control shaft 332 (i.e., a cam height) becomes gradually greater toward the aforementioned direction of rotation. In this specification, the nonoperating surface 352*a* and the operating surface 352*b* will be referred to simply as the swing cam surface 352 when one is not to be differentiated from the other.

A rocker roller 312 of the rocker arm 310 is disposed so as to oppose the swing cam surface 352. The rocker roller 312 is rotatably mounted at an intermediate portion of the rocker arm 310. A valve shaft 302 for supporting the valve 304 is mounted on one end of the rocker arm 310. The other end of the rocker arm 310 is rotatably supported by a hydraulic lash adjuster 306. The valve shaft 302 is pressed in a closing direction, i.e., a direction of pushing up the rocker arm 310 by a valve spring not shown. The rocker arm 310 is supported by the valve shaft 302 that receives the force of the valve spring. The rocker roller 312 is pressed against the swing cam surface 352 by the hydraulic lash adjuster 306.

[Operations Performed by the Variable Valve Operating Device According to the Second Embodiment]

The operation of the variable valve operating device 300 will be next described with reference to FIGS. 18 through 19.

(1) Valve Lift Operation Performed by the Variable Valve Operating Device

The lift operation of the variable valve operating device 300 will be described below with reference to FIG. 18. In the figure, (A) shows a condition of the variable valve operating device 300, in which the valve 304 (see FIG. 17; omitted in FIG. 18) is closed in a process of the lift operation. (B) shows a condition of the variable valve operating device 300, in which the valve 304 is open in a process of the lift operation.

In the variable valve operating device 300, the rotation motion of the drive cam 322 is first inputted to the eccentric arm 360 via the first roller 362 that is in contact with the drive cam surface 324. It is assumed that the drive cam 322 rotates clockwise in the Figure from the side of the leading end of the slide surface 356 toward the side of the control shaft 332. The eccentric arm 360 is rotatably supported by the eccentric disc 334 secured in a position within a space. Accordingly, the eccentric arm 360 rocks about the eccentric disc 334 in accordance with the rotation motion of the drive cam 322 inputted. The rocking motion of the eccentric arm 360 is inputted to the slide surface 356 of the swing cam arm 340 via the second roller 364. The slide surface 356 is pressed against the second roller 364 by a pressing force of the lost motion spring 390 (see FIG. 17; omitted in FIG. 18) at all times. Accordingly, the swing cam arm 340 rocks about the control shaft 332 according to the rocking motion of the eccentric arm 360.

More specifically, when the camshaft 320 rotates from the condition shown in FIG. 18(A), a contact position P1 of the first roller 362 on the drive cam surface 324 shifts from the nonoperating surface 324*a* to the operating surface 324*b* as shown in FIG. 18(B). The eccentric arm 360 is relatively pressed downward by the drive cam 322 and the slide surface 356 of the swing cam arm 340 is pressed downward by the eccentric arm 360. As a result, the swing cam arm 340 is rotated clockwise in the figure about the control shaft 332. As the camshaft 320 further rotates and the contact position P1 of the first roller 362 on the drive cam surface 324 moves past the vertex portion of the operating surface 324*b*, the swing cam arm 340 this time is rotated counterclockwise in the figure about the control shaft 332 by the force of the lost motion spring and the valve spring.

Rotation of the swing cam arm 340 about the control shaft 332 varies a contact position P3 of the rocker roller 312 on the swing cam surface 352. In the figure, the contact positions of the rocker roller 312 on the swing cam surface 352 are represented by reference numerals P3*i* and P3*f*. This is done to differentiate an initial contact position P3*i* from a final contact position P3*f* to be described later. In this specification, the contact position of the rocker roller 312 on the swing cam surface 352 will be generally referred to as the contact position P3.

Referring to FIG. 18(A), if the rocker roller 312 is in contact with the nonoperating surface 352*a*, the distance between the nonoperating surface 352*a* and the center of the control shaft 332 remains constant. Accordingly, there is no change in a special position of the rocker roller 312 regardless of the contact position. The rocker arm 310 does not therefore rock, thus retaining the valve 304 at a predetermined position. In the variable valve operating device 300, positional relationships among different components are adjusted so that the valve 304 is closed when the rocker roller 312 is in contact with the nonoperating surface 352*a*.

Referring to FIG. 18(B), when the contact position P3 of the rocker roller 312 on the swing cam surface 352 changes from the nonoperating surface 352*a* to the operating surface 352*b*, the rocker arm 310 is pressed downward according to the distance of the operating surface 352*b* from the center of the control shaft 332. The rocker arm 310 then rocks clockwise about the point of support by the hydraulic lash adjuster 306. As a result, the valve 304 is pressed downward by the rocker arm 310 and opened.

Figure 18:
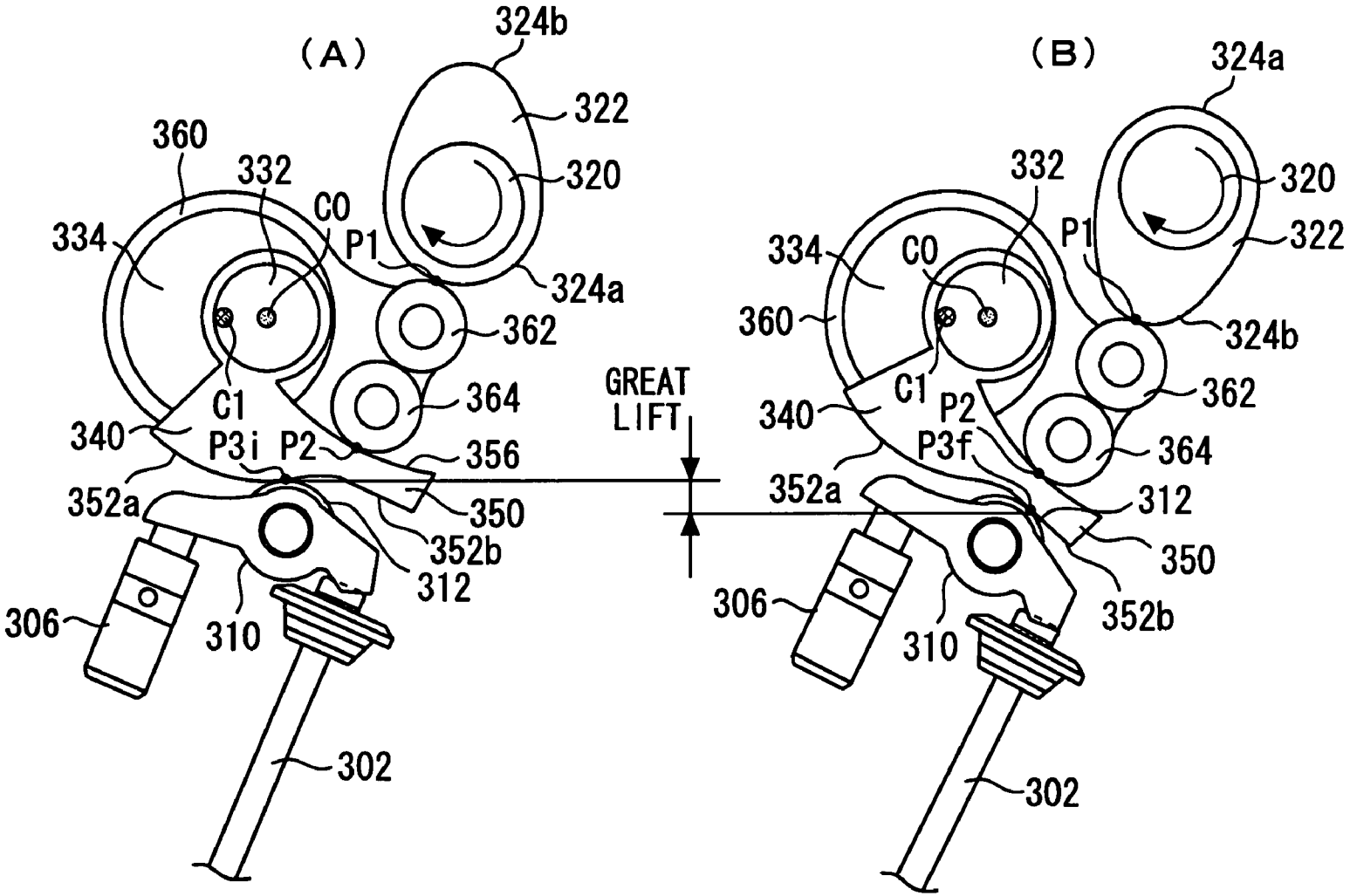
FIG. 18 illustrates a great lift operation performed by the variable valve operating device according to the second embodiment of the present invention, in the figure, (A) shows a valve open condition and (B) shows valve closed condition.

FIG. 18 shows a condition, in which the variable valve operating device 300 operates so as to give the valve 304 the maximum lift. FIG. 18(B) is a view showing positional relationships among individual members during the maximum lift. As in the first embodiment, individual members of the variable valve operating device 300 according to this embodiment are designed so that the contact position P1 of the first roller 362 on the drive cam surface 324, the contact position P2 of the second roller 364 on the slide surface 356, and the contact position P3 of the rocker roller 312 on the swing cam surface 352 are substantially aligned on a straight line connecting the center of the camshaft 320 and the center of the rocker roller 312 during the maximum lift. Referring to FIG. 18(A), the position of the eccentric disc 334 relative to the control shaft 332 is adjusted so that the contact positions P1, P2, and P3 between the corresponding pairs of individual members do not widely deviate from the straight line connecting the center of the camshaft 320 and the center of the rocker roller 312 even when the valve 304 is closed.

(2) Valve Lift Amount Change Operation Performed by the Variable Valve Operating Device The operation for changing valve lift amount in the variable valve operating device 300 will be next described with reference to FIGS. 18 and 19. FIG. 19 shows a condition, in which the variable valve operating device 300 operates so as to give the valve 304 (see FIG. 17; omitted in the Figure) a small lift. In each of the figures, (A) shows a condition of the variable valve operating device 300, in which the valve 304 is closed in a process of the lift operation. (B) shows a condition of the variable valve operating device 300, in which the valve 304 is open in a process of the lift operation.

Figure 19:
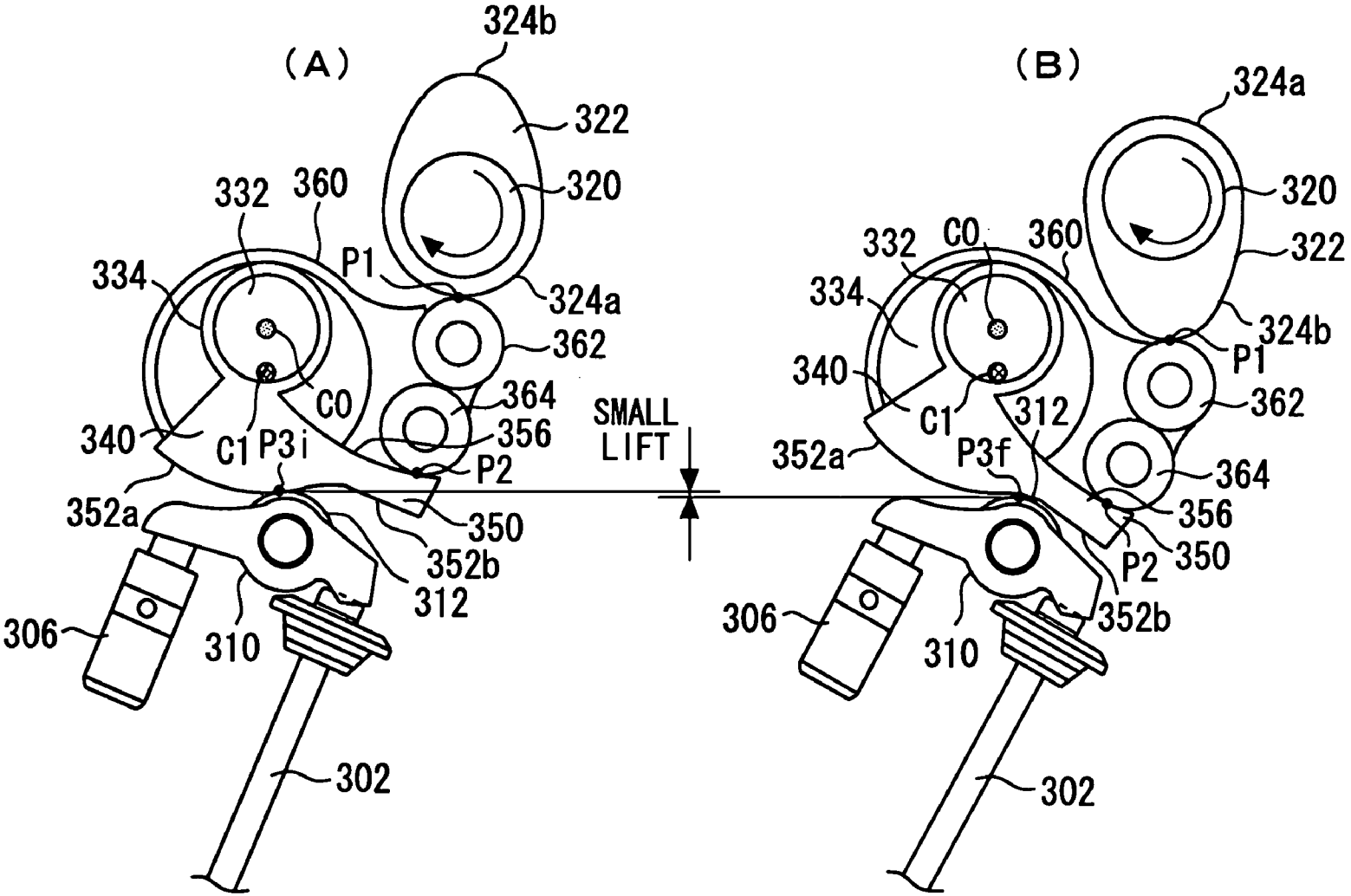
FIG. 19 illustrates a small lift operation performed by the variable valve operating device according to the second embodiment of the present invention, in the figure, (A) shows a valve open condition and (B) shows valve closed condition.

When the valve lift amount is changed from the valve lift amount shown in FIG. 18 to the valve lift amount shown in FIG. 19, the control shaft 332 is driven in the condition shown in FIG. 18(A), thereby rotatably moving the center C1 of the eccentric disc 334 to the position shown in FIG. 19(A). The eccentric arm 360 holds the first roller 362 and the second roller 364 at corresponding positions a predetermined distance away from the center C1 of the eccentric disc 334. Accordingly, as the center C1 of the eccentric disc 334 moves, the second roller 364 moves along the slide surface 356 in a direction of being away from the control shaft 332 from the position shown in FIG. 18(A) to the position shown in FIG. 19(A). At the same time, the first roller 362 moves to an upstream side in the direction of rotation thereof along the drive cam surface 324.

The movement of the second roller 364 moving in the direction of being away from the control shaft 332 makes longer the distance between a swing center C0 of the swing cam arm 340 and the contact position P2 of the second roller 364 on the slide surface 356. This decreases a swing angle of the swing cam arm 340. This is because the swing angle of the swing cam arm 340 is inversely proportional to the distance between the swing center C0 and the input point of oscillation. Referring to (B) in each figure, the lift of the valve 304 becomes the greatest when the contact position P1 of the first roller 362 on the drive cam surface 324 is located at the vertex portion of the operating surface 324*b*. The valve lift amount of the valve 304 is determined by the contact position P3*f* (hereinafter referred to as the final contact position) of the rocker roller 312 on the swing cam surface 352 at that particular point in time. As with the first embodiment (see FIG. 8), the final contact position P3*f* is determined by the contact position P3*i* (hereinafter referred to as the initial contact position) of the rocker roller 312 on the swing cam surface 352 shown in (A) of each figure and the swing angle of the swing cam arm 340.

In the variable valve operating device 300 according to this embodiment, the slide surface 356 is formed so that the greater the distance thereof from the swing center C0, the greater the distance from the cam base circle (nonoperating surface 324*a*) of the drive cam 322. Accordingly, the farther the aforementioned contact position P2 moves away from the swing center C0 of the swing cam arm 340, the more the swing cam arm 340 is inclined in a direction in which the slide surface 356 approaches the drive cam surface 324. In the figure, the swing cam arm 340 rotates counterclockwise about the control shaft 332. As a result, as shown in FIG. 19(A), the initial contact position P3*i* of the rocker roller 312 on the swing cam surface 352 moves in the direction of being away from the operating surface 352*b*.

By rotating the control shaft 332 as described above, the swing angle of the swing cam arm 340 decreases and the initial contact position P3*i* moves in the direction of being away from the operating surface 352*b*. As a result, the final contact position P3*f* to be reached by the rocker roller 312 moves on the side of the nonoperating surface 352*a*. This decreases the valve lift amount of the valve 304. The period (crank angle) through which the rocker roller 312 remains located on the operating surface 352*a* is the working angle of the valve 304; however, movement of the final contact position P3*f* onto the side of the nonoperating surface 352*a* decreases the working angle of the valve 304 also. Further, movement of the first roller 362 to the upstream side in the direction of rotation of the camshaft 320 causes the contact position P1 of the first roller 362 on the drive cam surface 324 when the camshaft 320 is at the same rotation position to move toward an advance side of the drive cam 322. This advances swing timing of the swing cam arm 340 relative to the phase of the camshaft 320, which results in valve timing (maximum lift timing) being advanced.

[Advantages of the Variable Valve Operating Device According to this Embodiment]

As described in the foregoing, according to the variable valve operating device 300 of this embodiment, the rotation position of the control shaft 332 is varied so as to change the contact position P2 of the second roller 364 on the slide surface 356 and the contact position P1 of the first roller 362 on the drive cam surface 324. This, in turn, allows the valve lift amount, working angle, and valve timing of the valve 304 to be varied in association with one another. In this case, forming the slide surface 356 into a curve helps suppress an initial swing position of the swing cam arm 340 from changing excessively relative to the change in the position of the first roller 362 on the drive cam surface 324.

Accordingly, in accordance with the variable valve operating device 300 of this embodiment, an excessive change in the valve lift amount can be suppressed with respect to changes in the valve timing in the same manner as with the variable valve operating device 100 of the first embodiment. It is therefore possible to realize an ideal valve timing-lift characteristic without using in combination the variable valve timing mechanism, such as the VVT or the like, or without having to let the variable valve timing mechanism, should one be used in combination, operate largely. That is, the valve timing-lift characteristic as shown in FIG. 10 or 11 can be realized even with the variable valve operating device 300 of this embodiment.

Moreover, according to the variable valve operating device 300 of this embodiment, the arrangement, in which the eccentric arm 360 for supporting the rollers 362, 364 is rotatably mounted on the outer peripheral surface of the eccentric disc 334 secured to the control shaft 332, allows a high rigidity to be secured and an operating stability during high speed operation to be achieved.

Third Embodiment

A third embodiment of the present invention will be described below with reference to FIGS. 20 through 22.

[Configuration of the Variable Valve Operating Device According to the Third Embodiment]

Figure 20:
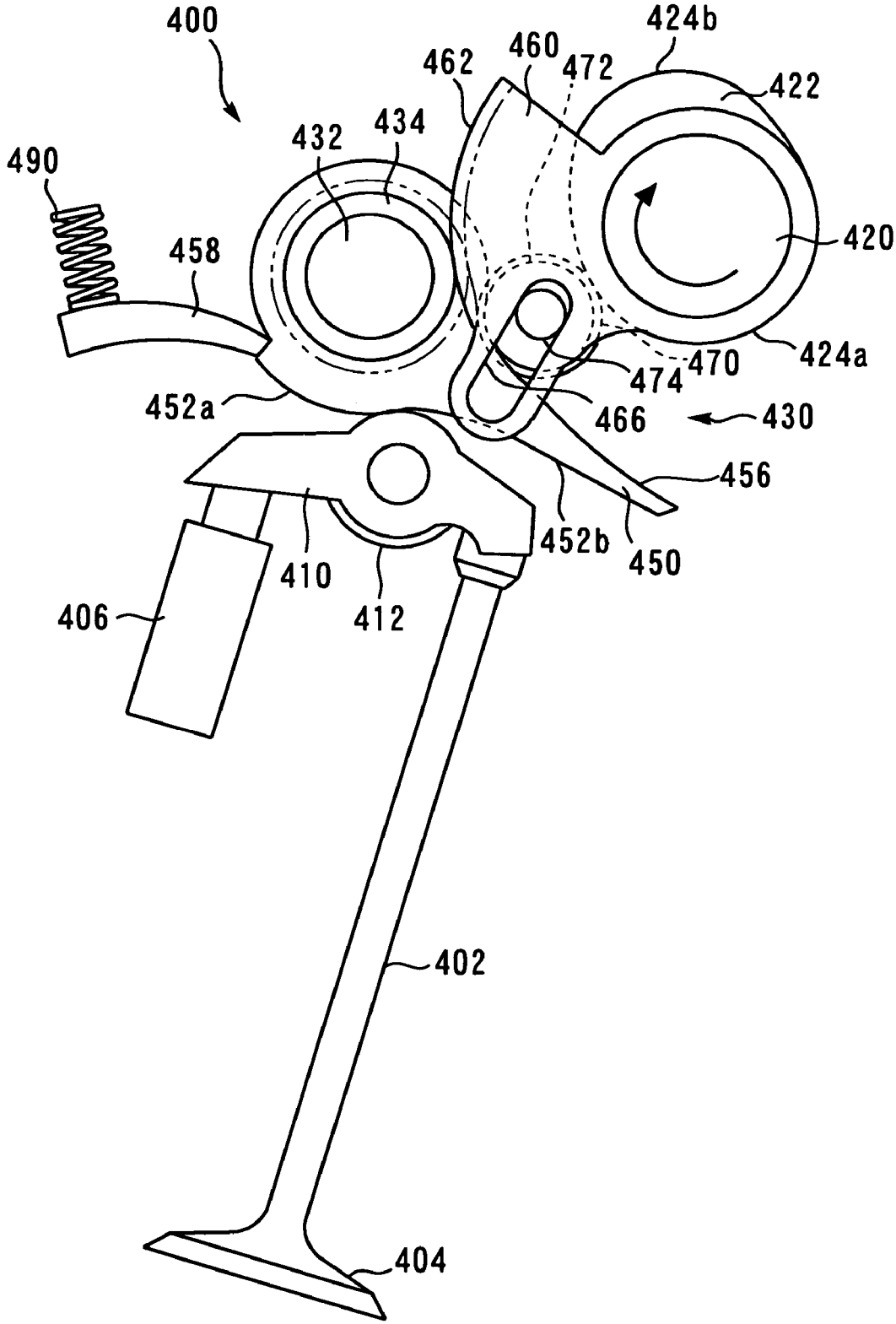
FIG. 20 is a side elevational view showing the configuration of a variable valve operating device according to the third embodiment of the present invention.

FIG. 20 is a side elevational view showing the configuration of a variable valve operating device 400 according to the third embodiment of the present invention. This variable valve operating device 400 includes a mechanical valve operating mechanism of a rocker arm type. Rotation motion of a camshaft 420 is converted to a rocking motion of a rocker arm (valve supporting member) 410 by a drive cam 422 disposed on the camshaft 420. This is, in turn, converted to a lift motion in the vertical direction of a valve 404 supported by the rocker arm 410. The drive cam 422 includes two cam surfaces 424*a*, 424*b* having different profiles from each other. One of the two cam surfaces, a nonoperating surface 424*a*, is formed to keep a predetermined distance from the center of the camshaft 420. The other of the two cam surfaces, an operating surface 424*b*, is formed so that the distance from the center of the camshaft 420 gradually grows larger and, after a vertex portion, gradually grows smaller. In this specification, the nonoperating surface 424*a* and the operating surface 424*b* will be referred to simply as the drive cam surface 424 when one is not to be differentiated from the other.

As in the first embodiment, the variable valve operating device 400 has an adjustment mechanism 430 interposed between the drive cam 422 and the rocker arm 410. The adjustment mechanism 430 interlocks the rocking motion of the rocker arm 410 with the rotation motion of the drive cam 422. As will be described below, the adjustment mechanism 430 includes, as major component members thereof, a control shaft 432, a swing cam arm (swing member) 450, a control arm (control member) 460, a first roller 470, a second roller 472, and a connecting shaft 474 connecting the first roller 470 to the second roller 472. The control shaft 432 is disposed to extend in parallel with, and be fixed relative to, the camshaft 420 at a position downstream of the rocker arm 410 in the direction of rotation of the camshaft 420. A first gear 434 concentric with the control shaft 432 is disposed on an outer peripheral surface of the control shaft 432. The first gear 434 is secured to the control shaft 432. An actuator not shown (e.g., a motor) is connected to the control shaft 432. An ECU of an internal combustion engine is able to adjust the rotation position of the control shaft 432 to any arbitrary value by controlling the actuator.

The swing cam arm 450 is rockably supported on the control shaft 432. The swing cam arm 450 is disposed so that a leading end thereof is oriented toward an upstream side in the direction of rotation of the drive cam 422. The swing cam arm 450 includes a slide surface 456 formed on the side of the swing cam arm 450 opposing the drive cam 422. The slide surface 456 contacts the second roller 472 to be described later. The slide surface 456 is curved gently toward the side of the drive cam 422. Further, the slide surface 456 is formed so that the distance from a cam base circle (nonoperating surface 424*a*) of the drive cam 422 increases at greater distances from the center of the control shaft 432 that serves as the swing center.

The swing cam arm 450 also includes a swing cam surface 452 (452*a*, 452*b*) formed on the surface opposite the slide surface 456 thereof. The swing cam surface 452 is a cam surface having the swing center of the swing cam arm 450 as a cam center. The swing cam surface 452 includes a nonoperating surface 452*a* and an operating surface 452*b* having different profiles from each other. The nonoperating surface 452*a* is a peripheral surface of a cam base circle, formed with a constant distance from the center of the control shaft 432. The other operating surface 452*b* is disposed on a leading end side of the swing cam arm 450 as viewed from the nonoperating surface 452*a*. The operating surface 452*b* is connected to the nonoperating surface 452*a* so as to smoothly continue thereinto. Further, the operating surface 452*b* is formed so that the distance from the center of the control shaft 432 (i.e., a cam height) becomes gradually greater toward the aforementioned leading end of the swing cam arm 450. In this specification, the nonoperating surface 452*a* and the operating surface 452*b* will be referred to simply as the swing cam surface 452 when one is not to be differentiated from the other.

The variable valve operating device 400 adopts a single-cam-two-valve-drive structure, in which the single drive cam 422 drives two valves 404. The swing cam arm 450 is therefore disposed in pairs on both sides of the drive cam 422 (in FIG. 20, only the swing cam arm 450 at the front side is shown). The rocker arm 410 is disposed for each of the pair of swing cam arms 450. The swing cam surface 452 is in contact with a rocker roller 412. The rocker roller 412 is rotatably mounted at an intermediate portion of the rocker arm 410. A valve shaft 402 for supporting the valve 404 is mounted on one end of the rocker arm 410. The other end of the rocker arm 410 is rotatably supported by a hydraulic lash adjuster 406. The valve shaft 402 is pressed in a closing direction, i.e., a direction of pushing up the rocker arm 410 by a valve spring not shown. The rocker arm 410 is supported by the valve shaft 402 that receives the force of the valve spring. The rocker roller 412 is pressed against the swing cam surface 452 by the hydraulic lash adjuster 406.

The swing cam arm 450 also includes a spring seat 458, to which a lost motion spring 490 is to be hooked. The spring seat 458 is disposed rearward of the nonoperating surface 452*a* to extend in a direction opposite to a direction along which the swing cam arm 450 extends. The lost motion spring 490 is a compression spring. The other end portion of the lost motion spring 490 is hooked onto a stationary member not shown. The swing cam arm 450 is urged to rotate to the side of the slide surface 456 by a spring force acting on the spring seat 458 from the lost motion spring 490.

The control arm 460 is rotatably supported on the camshaft 420. The control arm 460 includes a sector-like second gear 462 formed along an arc concentric with the center of rotation of the control arm 460, i.e., the camshaft 420. The position of the control arm 460 on the camshaft 420 is adjusted so that the second gear 462 is positioned flush with the first gear 434. Further, the rotational phase of the control arm 460 is adjusted so that the second gear 462 opposes the first gear 434. The second gear 462 is meshed with the first gear 434, so that rotation of the control shaft 432 may be inputted to the control arm 460 via the first gear 434 and the second gear 462. More specifically, the first gear 434 and the second gear 462 constitute an interlock mechanism that interlocks the rotation of the control arm 460 with the rotation of the control shaft 432. In addition, the second gear 462 is arranged to have a diameter larger than the diameter of the first gear 434. Accordingly, the first gear 434 and the second gear 462 constitute a reduction mechanism that transmits rotation of the control shaft 432 to the control arm 460 through speed reduction.

The control arm 460 is disposed in pairs on both sides of the drive cam 422 (in FIG. 20, the control arm 460 on the front side only is shown). The first gear 434 is also disposed in pairs on the outside of the right and left swing cam arms 450 for the control arm 460. The first gear 434 is meshed with the second gear 462 of the corresponding control arm 460.

The control arm 460 includes a guide 466 integrally formed therewith. The guide 466 extends from the side of the center of the camshaft 420 outwardly, i.e., substantially in a diametric direction of the camshaft 420. The control arm 460 is adjusted to keep a general rotation position relative to the camshaft 420 so that the guide 466 opposes substantially at right angle with the slide surface 456 of the swing cam arm 450. As described earlier, there is disposed a pair of the control arms 460 on both sides of the drive cam 422. Each of the right and left control arms 460 is formed with the guide 466. The connecting shaft 474 is passed through the right and left guides 466. The connecting shaft 474 is arranged to be movable along the guides 466. One first roller 470 and two second rollers 472, each being disposed on either side of the first roller 470, are rotatably supported on the connecting shaft 474 (in FIG. 20, only the second roller 472 at the front side is shown). The rollers 470, 472 are disposed so as to be sandwiched between the drive cam surface 424 and the slide surface 456. The first roller 470 is in contact with the drive cam surface 424. The second roller 472 is in contact with the slide surface 456 of each of the swing cam arms 450. The swing cam arm 450 is pushed upward by a force received from the lost motion spring 490. The second roller 472 is pushed upward by the slide surface 456. The first roller 470 coaxially integrated with the second roller 472 is pressed against the drive cam surface 424.

[Operations Performed by the Variable Valve Operating Device According to the Second Embodiment]

The operation of the variable valve operating device 400 will be next described with reference to FIGS. 21 through 22. In FIGS. 21 through 22, the control arm 460 and the first gear 434 on the front side are omitted for better understanding of the movement of the rollers 470, 472.

(1) Valve Lift Operation Performed by the Variable Valve Operating Device

The lift operation of the variable valve operating device 400 will be described below with reference to FIG. 21. In the figure, (A) shows a condition of the variable valve operating device 400, in which the valve 404 is closed in a process of the lift operation. (B) shows a condition of the variable valve operating device 400, in which the valve 404 is open in a process of the lift operation.

In the variable valve operating device 400, the rotation motion of the drive cam 422 is first inputted to the first roller 470 that is in contact with the drive cam surface 424. The first roller 470, together with the second roller 472 disposed integrally coaxially therewith, makes a reciprocating movement along the guide 466. At this time, the control arm 460 is freely rotatable relative to the camshaft 420. Rotation of the control arm 460 is also restricted by the control shaft 432 via the first gear 434 (see FIG. 20) and the second gear 462. The control arm 460 therefore remains stationary in a predetermined posture regardless of the rotation of the drive cam 422. The reciprocating movement of the rollers 470, 472 along the guide 466 is inputted to the slide surface 456 of the swing cam arm 450 that supports the second roller 472. The slide surface 456 is pressed against the second roller 472 by the force of the lost motion spring (not shown) at all times. Accordingly, the swing cam arm 450 rocks about the control shaft 432 according to the rotation of the drive cam 422.

More specifically, when the camshaft 420 rotates from the condition shown in FIG. 21(A), a contact position P1 of the first roller 470 on the drive cam surface 424 shifts from the nonoperating surface 424*a* to the operating surface 424*b* as shown in FIG. 21(B). The first roller 470 is relatively pressed downward by the drive cam 422 and, together with the second roller 472 integrated coaxially therewith, rotates along a trajectory defined by the guide 466. As a result, the swing cam arm 450 is rotated clockwise in the figure about the control shaft 432 as a result of the slide surface 456 thereof being pushed downward by the second roller 472. As the camshaft 420 further rotates and the contact position P1 of the first roller 470 on the drive cam surface 424 moves past the vertex portion of the operating surface 424*b*, the swing cam arm 450 this time is rotated counterclockwise in the figure about the control shaft 432 by the force of the lost motion spring and the valve spring.

Rotation of the swing cam arm 450 about the control shaft 432 varies a contact position P3 of the rocker roller 412 on the swing cam surface 452. In the figure, the contact positions of the rocker roller 412 on the swing cam surface 452 are represented by reference numerals P3*i* and P3*f*. This is done to differentiate an initial contact position P3*i* from a final contact position P3*f* to be described later. In this specification, the contact position of the rocker roller 412 on the swing cam surface 452 will be generally referred to as the contact position P3.

Referring to FIG. 21(A), if the rocker roller 412 is in contact with the nonoperating surface 452*a*, the distance between the nonoperating surface 452*a* and the center of the control shaft 432 remains constant. Accordingly, there is no change in a special position of the rocker roller 412 regardless of the contact position. The rocker arm 410 does not therefore rock, thus retaining the valve 404 at a predetermined position. In the variable valve operating device 400, positional relationships among different portions are adjusted so that the valve 404 is closed when the rocker roller 412 is in contact with the nonoperating surface 452*a*.

Referring to FIG. 21(B), when the contact position P3 of the rocker roller 412 on the swing cam surface 452 changes from the nonoperating surface 452*a* to the operating surface 452*b*, the rocker arm 410 is pressed downward according to the distance of the operating surface 452*b* from the center of the control shaft 432. The rocker arm 410 then rocks clockwise about the point of support by the hydraulic lash adjuster 406. As a result, the valve 404 is pressed downward by the rocker arm 410 and opened.

Figure 21:
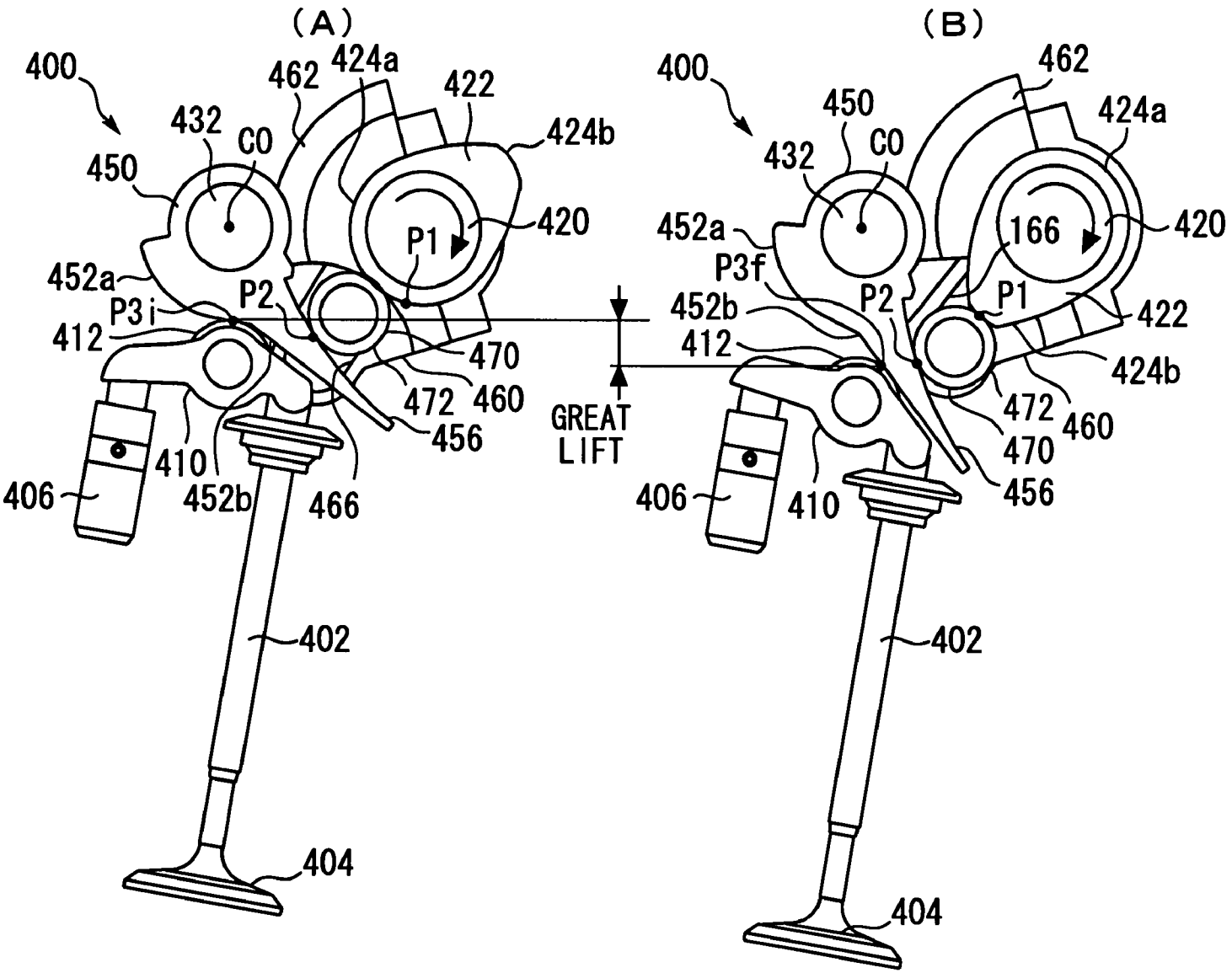
FIG. 21 illustrates a great lift operation performed by the variable valve operating device according to the third embodiment of the present invention, in the figure, (A) shows a valve open condition and (B) shows valve closed condition.

FIG. 21 shows a condition, in which the variable valve operating device 400 operates so as to give the valve 404 the maximum lift. FIG. 21(B) is a view showing positional relationships among individual members during the maximum lift. As in the first embodiment, individual members of the variable valve operating device 400 according to this embodiment are designed so that the contact position P1 of the first roller 470 on the drive cam surface 424, the contact position P2 of the second roller 472 on the slide surface 456, and the contact position P3 of the rocker roller 412 on the swing cam surface 452 are substantially aligned on a straight line connecting the center of the camshaft 420 and the center of the rocker roller 412 during the maximum lift. Referring to FIG. 21(A), the direction of the guide 466 relative to the camshaft 420 is adjusted so that the contact positions P1, P2, and P3 between the corresponding pairs of individual members do not widely deviate from the straight line connecting the center of the camshaft 420 and the center of the rocker roller 412 even when the valve 404 is closed.

(2) Valve Lift Amount Change Operation Performed by the Variable Valve Operating Device The operation for changing valve lift amount in the variable valve operating device 400 will be next described with reference to FIGS. 21 and 22. FIG. 22 shows a condition, in which the variable valve operating device 400 operates so as to give the valve 404 a small lift. In the figure, (A) shows a condition of the variable valve operating device 400, in which the valve 404 is closed in a process of the lift operation. (B) shows a condition of the variable valve operating device 400, in which the valve 404 is open in a process of the lift operation.

Figure 22:
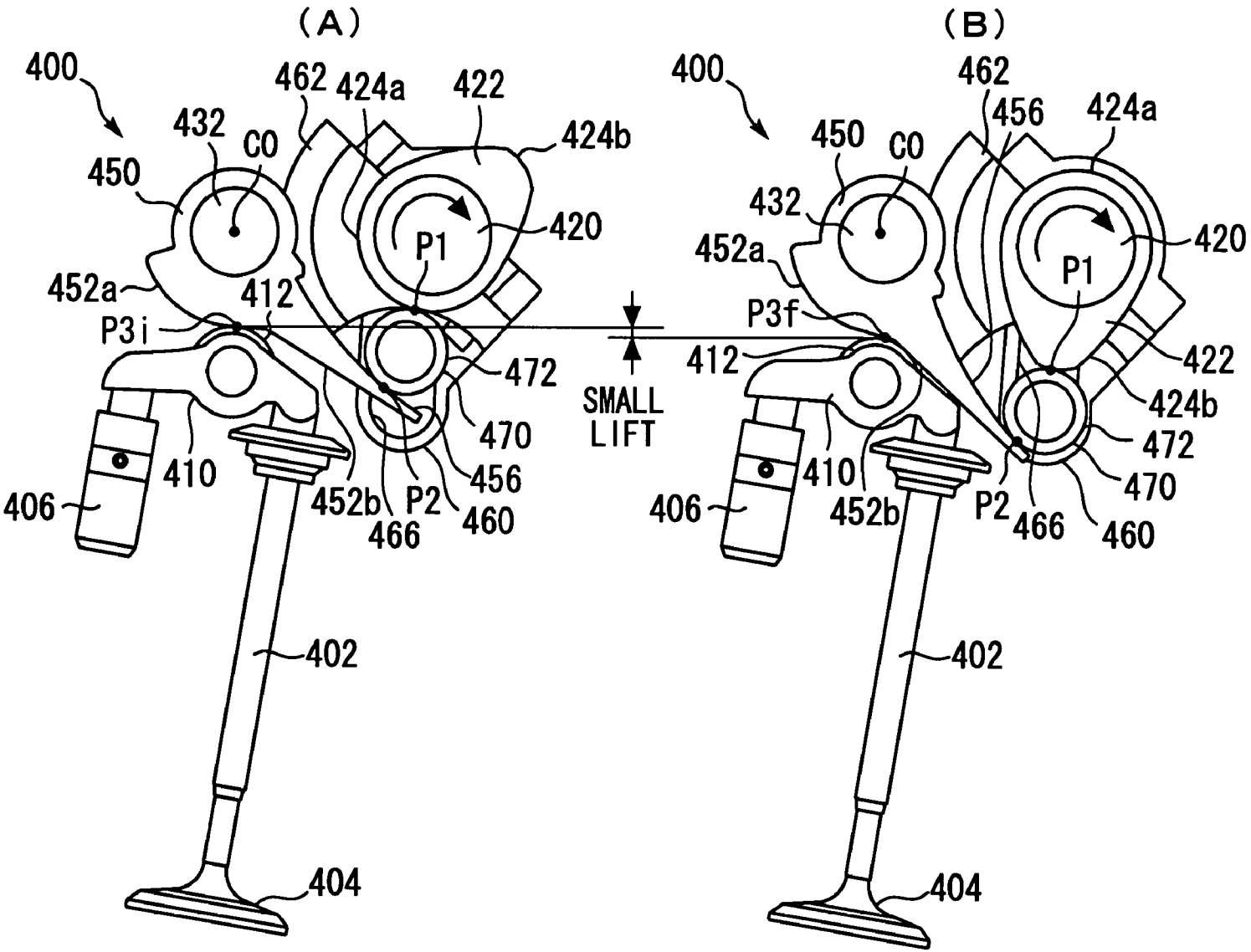
FIG. 22 illustrates a small lift operation performed by the variable valve operating device according to the third embodiment of the present invention, in the figure, (A) shows a valve open condition and (B) shows valve closed condition.

When the valve lift amount is changed from the valve lift amount shown in FIG. 21 to the valve lift amount shown in FIG. 22, the control shaft 432 is driven in the same direction (clockwise in the figure) as the rotational direction of the camshaft 420 in the condition shown in FIG. 21(A), thereby rotating the control arm 460 to the rotation position shown in FIG. 22(A). The amount of rotation of the control arm 460 is determined by the amount of rotation of the control shaft 432 and the gear ratio of the first gear 434 (see FIG. 1) and the second gear 462. The rollers 470, 472 are coupled to the control arm 460 through the control link 164. Accordingly, as the control arm 460 rotates, the first roller 470 moves to an upstream side in the direction of rotation of the camshaft 420 along the drive cam surface 424. The second roller 472, on the other hand, moves along the slide surface 456 in a direction of being away from the control shaft 432.

The movement of the second roller 472 moving in the direction of being away from the control shaft 432 makes longer the distance between a swing center C0 of the swing cam arm 450 and the contact position P2 of the second roller 472 on the slide surface 456. This decreases a swing angle of the swing cam arm 450. This is because the swing angle of the swing cam arm 450 is inversely proportional to the distance between the swing center C0 and the input point of oscillation, i.e., the contact position P2. Referring to (B) in each figure, the lift of the valve 404 becomes the greatest when the contact position P1 of the first roller 470 on the drive cam surface 424 is located at the vertex portion of the operating surface 424*b*. The valve lift amount of the valve 404 is determined by the contact position P3*f* (hereinafter referred to as the final contact position) of the rocker roller 412 on the swing cam surface 452 at that particular point in time. As with the first embodiment (see FIG. 8), the final contact position P3*f* is determined by the contact position P3*i* (hereinafter referred to as the initial contact position) of the rocker roller 412 on the swing cam surface 452 shown in (A) of each figure and the swing angle of the swing cam arm 450.

In the variable valve operating device 400 according to this embodiment, the slide surface 456 is formed so that the greater the distance thereof from the swing center, the greater the distance from the cam base circle (nonoperating surface 424*a*) of the drive cam 422. Accordingly, the farther the aforementioned contact position P2 moves away from the swing center C0 of the swing cam arm 450, the more the swing cam arm 450 is inclined in a direction in which the slide surface 456 approaches the drive cam surface 424. In the figure, the swing cam arm 450 rotates counterclockwise about the control shaft 432. As a result, as shown in FIG. 22(A), the initial contact position P3*i* of the rocker roller 412 on the swing cam surface 452 moves in the direction of being away from the operating surface 452*b*.

By rotating the control shaft 432 in the same direction as the camshaft 420 as described above, the swing angle of the swing cam arm 450 decreases and the initial contact position P3*i* moves in the direction of being away from the operating surface 452*b*. As a result, the final contact position P3*f* to be reached by the rocker roller 412 moves on the side of the nonoperating surface 452*a*. This decreases the valve lift amount of the valve 404. The period (crank angle) through which the rocker roller 412 remains located on the operating surface 452*a* is the working angle of the valve 404; however, movement of the final contact position P3*f* onto the side of the nonoperating surface 452*a* decreases the working angle of the valve 404 also. Further, movement of the first roller 470 to the upstream side in the direction of rotation of the camshaft 420 causes the contact position P1 of the first roller 470 on the drive cam surface 424 when the camshaft 420 is at the same rotation position to move toward an advance side of the drive cam 422. This advances swing timing of the swing cam 450 relative to the phase of the camshaft 420, which results in valve timing (maximum lift timing) being advanced.

[Advantages of the Variable Valve Operating Device According to this Embodiment]

As described in the foregoing, according to the variable valve operating device 400 of this embodiment, the rotation position of the control shaft 432 is varied so as to change the contact position P2 of the second roller 472 on the slide surface 456 and the contact position P1 of the first roller 470 on the drive cam surface 424. This, in turn, allows the valve lift amount, working angle, and valve timing of the valve 404 to be varied in association with one another. In this case, forming the slide surface 456 into a curve helps suppress an initial swing position of the swing cam arm 450 from changing excessively relative to the change in the position of the first roller 470 on the drive cam surface 424.

Accordingly, in accordance with the variable valve operating device 400 of this embodiment, an excessive change in the valve lift amount can be suppressed with respect to changes in the valve timing in the same manner as with the variable valve operating device 100 of the first embodiment.

It is therefore possible to realize an ideal valve timing-lift characteristic without using in combination the variable valve timing mechanism, such as the VVT or the like, or without having to let the variable valve timing mechanism, should one be used in combination, operate largely. That is, the valve timing-lift characteristic as shown in FIG. 10 or 11 can be realized even with the variable valve operating device 400 of this embodiment.

Further, in accordance with the variable valve operating device 400 of this embodiment, the control arm 460 is mounted on the existing camshaft 420 and used for supporting the rollers 470, 472. This arrangement allows the entire device to be structured compactly. Moreover, only the rollers 470, 472 and the swing cam arm 450 are movable of the adjustment mechanism 430 during a lift motion. This helps suppress an increase in the inertia mass of the entire movable portion.

Fourth Embodiment

A fourth embodiment of the present invention will be described below with reference to FIGS. 23 through 25.

[Configuration of the Variable Valve Operating Device According to the Fourth Embodiment]

Figure 23:
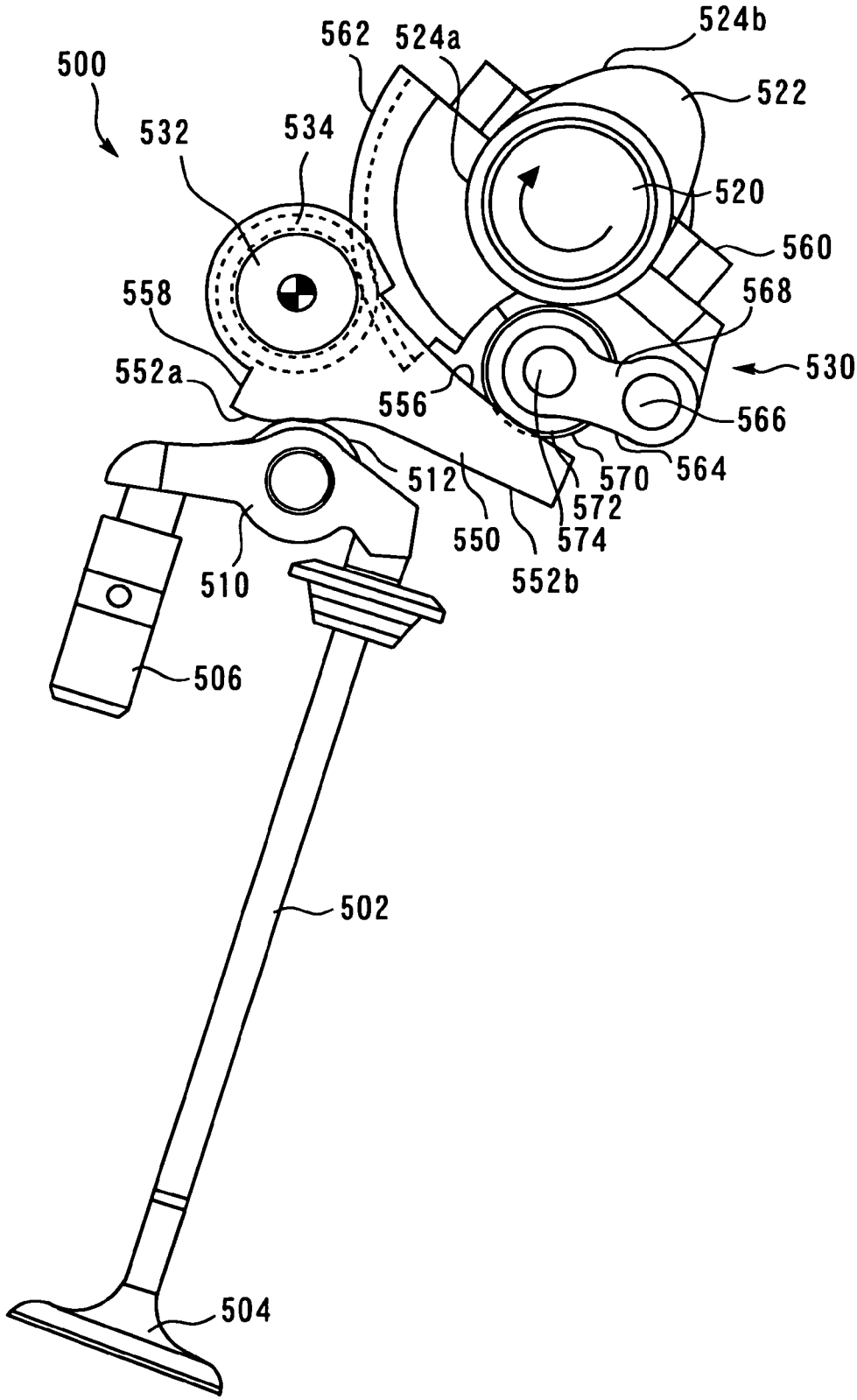
FIG. 23 is a side elevational view showing the configuration of a variable valve operating device according to the fourth embodiment of the present invention.

FIG. 23 is a side elevational view showing the configuration of a variable valve operating device 500 according to the fourth embodiment of the present invention. This variable valve operating device 500 includes a mechanical valve operating mechanism of a rocker arm type. Rotation motion of a camshaft 520 is converted to a rocking motion of a rocker arm (valve supporting member) 510 by a drive cam 522 disposed on the camshaft 520. This is, in turn, converted to a lift motion in the vertical direction of a valve 504 supported by the rocker arm 510. The drive cam 522 includes two cam surfaces 524*a*, 524*b* having different profiles from each other. One of the two cam surfaces, a nonoperating surface 524*a*, is formed to keep a predetermined distance from the center of the camshaft 520. The other of the two cam surfaces, an operating surface 524*b*, is formed so that the distance from the center of the camshaft 520 gradually grows larger and, after a vertex portion, gradually grows smaller. In this specification, the nonoperating surface 524*a* and the operating surface 524*b* will be referred to simply as the drive cam surface 524 when one is not to be differentiated from the other.

As in the first embodiment, the variable valve operating device 500 has an adjustment mechanism 230 interposed between the drive cam 522 and the rocker arm 510. The adjustment mechanism 230 interlocks the rocking motion of the rocker arm 510 with the rotation motion of the drive cam 522. As will be described below, the adjustment mechanism 230 includes, as major component members thereof, a control shaft 532, a swing cam arm (swing member) 550, a control arm (control member) 560, a control link (link member) 564, a first roller 570, a second roller 572, and a connecting shaft 574 connecting the first roller 570 to the second roller 572. The control shaft 532 is disposed to extend in parallel with, and be fixed relative to, the camshaft 520 at a position downstream of the rocker arm 510 in the direction of rotation of the camshaft 520. A first gear 534 concentric with the control shaft 532 is disposed on an outer peripheral surface of the control shaft 532. The first gear 534 is secured to the control shaft 532. An actuator not shown (e.g., a motor) is connected to the control shaft 532. An ECU of an internal combustion engine is able to adjust the rotation position of the control shaft 532 to any arbitrary value by controlling the actuator.

The swing cam arm 550 is rockably supported on the control shaft 532. The swing cam arm 550 is disposed so that a leading end thereof is oriented toward an upstream side in the direction of rotation of the drive cam 522. The swing cam arm 550 includes a slide surface 556 formed on the side of the swing cam arm 550 opposing the drive cam 522. The slide surface 556 contacts the second roller 572 to be described later. The slide surface 556 is curved gently toward the side of the drive cam 522. Further, the slide surface 556 is formed so that the distance from a cam base circle (nonoperating surface 522*a*) of the drive cam 522 increases at greater distances from the center of the control shaft 532 that serves as the swing center.

The swing cam arm 550 also includes a swing cam surface 552 (552*a*, 552*b*) formed on the surface opposite the slide surface 556 thereof. The swing cam surface 552 is a cam surface having the swing center of the swing cam arm 550 as a cam center. The swing cam surface 552 includes a nonoperating surface 552*a* and an operating surface 552*b* having different profiles from each other. The nonoperating surface 552*a* is a peripheral surface of a cam base circle, formed with a constant distance from the center of the control shaft 532. The other operating surface 552*b* is disposed on a leading end side of the swing cam arm 550 as viewed from the nonoperating surface 552*a*. The operating surface 552*b* is connected to the nonoperating surface 552*a* so as to smoothly continue thereinto. Further, the operating surface 552*b* is formed so that the distance from the center of the control shaft 532 (i.e., a cam height) becomes gradually greater toward the aforementioned leading end of the swing cam arm 550. In this specification, the nonoperating surface 552*a* and the operating surface 552*b* will be referred to simply as the swing cam surface 552 when one is not to be differentiated from the other.

The variable valve operating device 500 adopts a single-cam-two-valve-drive structure, in which the single drive cam 522 drives two valves 504. The swing cam arm 550 is therefore disposed in pairs on both sides of the drive cam 522 (in FIG. 23, only the swing cam arm 550 at the front side is shown). The rocker arm 510 is disposed for each of the pair of swing cam arms 550. The swing cam surface 552 of the swing cam arm 550 is in contact with a rocker roller 512 of the rocker arm 510. The rocker roller 512 is rotatably mounted at an intermediate portion of the rocker arm 510. A valve shaft 502 for supporting the valve 504 is mounted on one end of the rocker arm 510. The other end of the rocker arm 510 is rotatably supported by a hydraulic lash adjuster 506. The valve shaft 502 is pressed in a closing direction, i.e., a direction of pushing up the rocker arm 510 by a valve spring not shown. The rocker arm 510 is supported by the valve shaft 502 that receives the force of the valve spring. The rocker roller 512 is pressed against the swing cam surface 552 by the hydraulic lash adjuster 506.

The swing cam arm 550 also includes a spring seating face 558, to which a lost motion spring not shown is to be hooked. The spring seating face 558 is formed on the side opposite the operating surface 556*b* relative to the nonoperating surface 552*a*. The lost motion spring is a compression spring. The other end portion of the lost motion spring is hooked onto a stationary member not shown. The swing cam arm 550 is urged to rotate to the side of the slide surface 556 by a spring force acting on the spring seating face 558 from the lost motion spring.

The control arm 560 is rotatably supported on the camshaft 520. The control arm 560 includes a sector-like second gear 562 formed along an arc concentric with the center of rotation of the control arm 560, i.e., the camshaft 520. The position of the control arm 560 on the camshaft 520 is adjusted so that the second gear 562 is positioned flush with the first gear 534. Further, the rotational phase of the control arm 560 is adjusted so that the second gear 562 opposes the first gear 534. The second gear 562 is meshed with the first gear 534, so that rotation of the control shaft 532 may be inputted to the control arm 560 via the first gear 534 and the second gear 562. More specifically, the first gear 534 and the second gear 562 constitute an interlock mechanism that interlocks the rotation of the control arm 560 with the rotation of the control shaft 532. In addition, the second gear 562 is arranged to have a diameter larger than the diameter of the first gear 534. Accordingly, the first gear 534 and the second gear 562 constitute a reduction mechanism that transmits rotation of the control shaft 532 to the control arm 560 through speed reduction.

The control link 564 is rotatably mounted on the control arm 560 at a position eccentric from the center of rotation of the control arm 560, i.e., the center of the camshaft 520. The control link 564 has connection pins 566 disposed on an end on the side of a pivot of the control link 564. The connection pins 566 are rotatably supported on the control arm 560. The connection pins 566 are located on the control arm 560 on the side substantially opposite the second gear 562 relative to the center of rotation of the control arm 560. The control link 564 is pivotally disposed about the connection pins 566 so that a leading end thereof faces the control shaft 532. The control arm 560 is disposed in pairs on both sides of the drive cam 522. The right and left control arms 560 support the control link 564 (in FIG. 23, the control arm 560 on the front side is omitted).

The control link 564 includes a pair of right and left arms 568 that supports the connecting shaft 574 (in FIG. 23, the arm 568 on the front side only is shown). One first roller 570 and two second rollers 572, each being disposed on either side of the first roller 570, are rotatably supported on the connecting shaft 574 (in FIG. 23, the second roller 572 on the front side only is shown). The control link 564 is disposed so that a leading end thereof is oriented toward the control shaft 532 so as to oppose a direction along which the swing cam arm 550 extends. The rollers 570, 572 are disposed so as to be sandwiched between the drive cam surface 524 and the slide surface 556. The first roller 570 is in contact with the drive cam surface 524. The second roller 572 is in contact with the slide surface 556 of each of the swing cam arms 550. The second roller 572 is pushed upward by the slide surface 556 by the force the swing cam arm 550 receives from the lost motion spring. The first roller 570 coaxially integrated with the second roller 572 is pressed against the drive cam surface 524.

[Operations Performed by the Variable Valve Operating Device According to the Fourth Embodiment]

The operation of the variable valve operating device 500 will be next described with reference to FIGS. 24 through 25.

(1) Valve Lift Operation Performed by the Variable Valve Operating Device

The lift operation of the variable valve operating device 500 will be described below with reference to FIG. 24. In the figure, (A) shows a condition of the variable valve operating device 500, in which the valve 504 is closed in a process of the lift operation. (B) shows a condition of the variable valve operating device 500, in which the valve 504 is open in a process of the lift operation.

In the variable valve operating device 500, the rotation motion of the drive cam 522 is first inputted to the first roller 570 that is in contact with the drive cam surface 524. The first roller 570, together with the second roller 572 disposed integrally coaxially therewith, rotates about the pin 566. This movement is inputted to the slide surface 556 of the swing cam arm 550 that supports the second roller 572. The slide surface 556 is pressed against the second roller 572 by the force of the lost motion spring (not shown) at all times. Accordingly, the swing cam arm 550 rocks about the control shaft 532 according to the rotation of the drive cam 522.

More specifically, when the camshaft 520 rotates from the condition shown in FIG. 24(A), a contact position P1 of the first roller 570 on the drive cam surface 524 shifts from the nonoperating surface 524*a* to the operating surface 524*b* as shown in FIG. 24(B). The first roller 570 is relatively pressed downward by the drive cam 522 and, together with the second roller 572 integrated coaxially therewith, rotates along a trajectory defined by the control link 564. As a result, the swing cam arm 550 is rotated clockwise in the figure about the control shaft 532 as a result of the slide surface 556 thereof being pushed downward by the second roller 572. As the camshaft 520 further rotates and the contact position P1 of the first roller 570 on the drive cam surface 524 moves past the vertex portion of the operating surface 524*b*, the swing cam arm 550 this time is rotated counterclockwise in the figure about the control shaft 532 by the force of the lost motion spring.

Rotation of the swing cam arm 550 about the control shaft 532 varies a contact position P3 of the rocker roller 512 on the swing cam surface 552. In the figure, the contact positions of the rocker roller 512 on the swing cam surface 552 are represented by reference numerals P3*i* and P3*f*. This is done to differentiate an initial contact position P3*i* from a final contact position P3*f* to be described later. In this specification, the contact position of the rocker roller 512 on the swing cam surface 552 will be generally referred to as the contact position P3.

Referring to FIG. 24(A), if the rocker roller 512 is in contact with the nonoperating surface 552*a*, the distance between the nonoperating surface 552*a* and the center of the control shaft 532 remains constant. Accordingly, there is no change in a special position of the rocker roller 512 regardless of the contact position. The rocker arm 510 does not therefore rock, thus retaining the valve 504 at a predetermined position. In the variable valve operating device 500, positional relationships among individual components are adjusted so that the valve 504 is closed when the rocker roller 512 is in contact with the nonoperating surface 552*a*.

Referring to FIG. 24(B), when the contact position P3 of the rocker roller 512 on the swing cam surface 552 changes from the nonoperating surface 552*a* to the operating surface 552*b*, the rocker arm 510 is pressed downward according to the distance of the operating surface 552*b* from the center of the control shaft 532. The rocker arm 510 then rocks clockwise about the point of support by the hydraulic lash adjuster 106. As a result, the valve 504 is pressed downward by the rocker arm 510 and opened.

Figure 24:
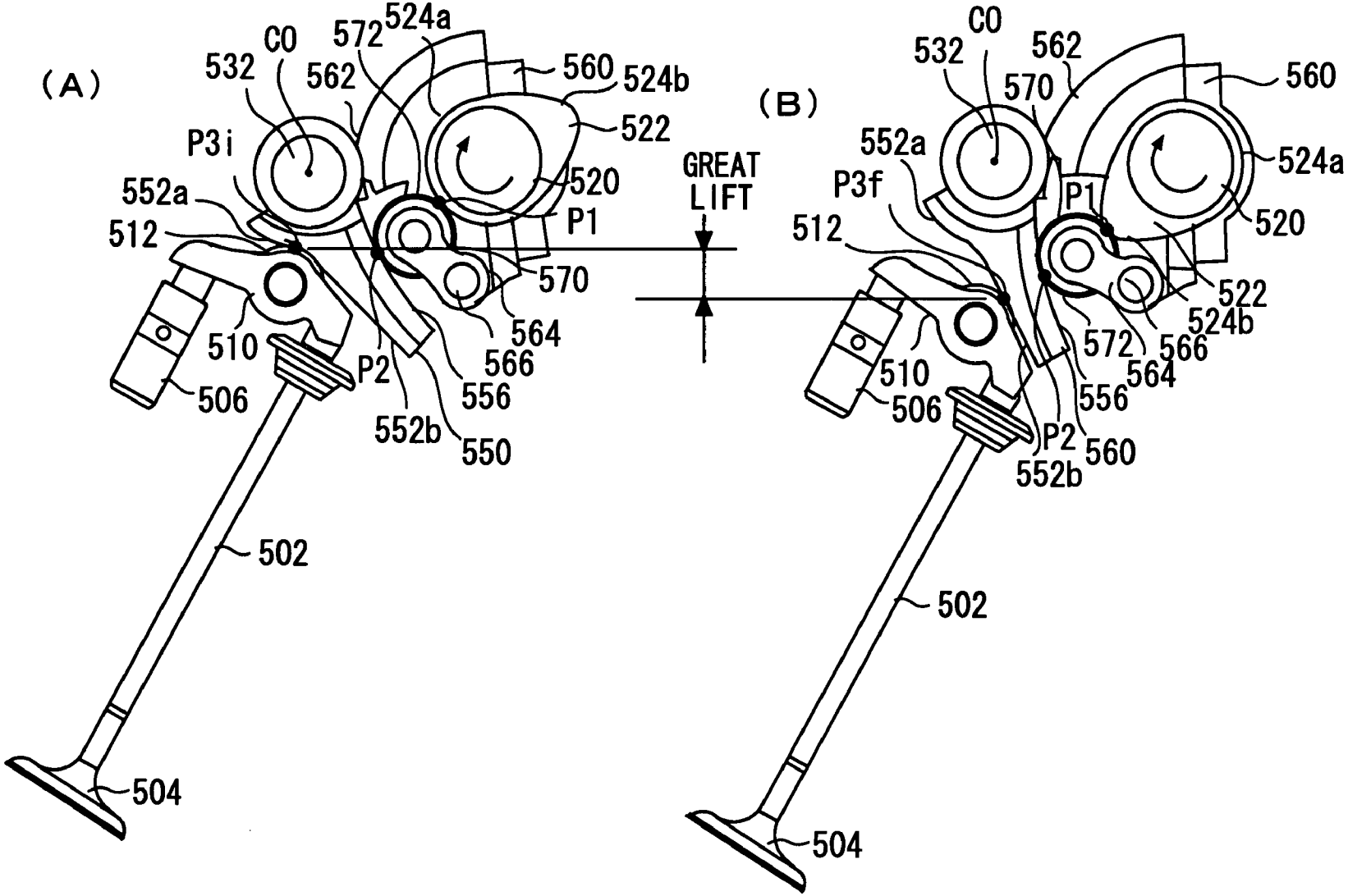
FIG. 24 illustrates a great lift operation performed by the variable valve operating device according to the fourth embodiment of the present invention, in the figure, (A) shows a valve open condition and (B) shows valve closed condition.

FIG. 24 shows a condition, in which the variable valve operating device 500 operates so as to give the valve 504 the maximum lift. FIG. 24(B) is a view showing positional relationships among individual members during the maximum lift. As in the first embodiment, individual members of the variable valve operating device 500 according to this embodiment are designed so that the contact position P1 of the first roller 570 on the drive cam surface 524, the contact position P2 of the second roller 572 on the slide surface 556, and the contact position P3 of the rocker roller 512 on the swing cam surface 552 are substantially aligned on a straight line connecting the center of the camshaft 520 and the center of the rocker roller 512 during the maximum lift. Referring to FIG. 24(A), the position of the rocking center (pin 566) of the control link 564 relative to the camshaft 520 is adjusted so that the contact positions P1, P2, and P3 between the corresponding pairs of individual members do not widely deviate from the straight line connecting the center of the camshaft 520 and the center of the rocker roller 512 even when the valve 504 is closed.

(2) Valve Lift Amount Change Operation Performed by the Variable Valve Operating Device The operation for changing valve lift amount in the variable valve operating device 500 will be next described with reference to FIGS. 24 and 25. FIG. 25 shows a condition, in which the variable valve operating device 500 operates so as to give the valve 504 a small lift. In each figure, (A) shows a condition of the variable valve operating device 500, in which the valve 504 is closed in a process of the lift operation. (B) shows a condition of the variable valve operating device 500, in which the valve 504 is open in a process of the lift operation.

Figure 25:
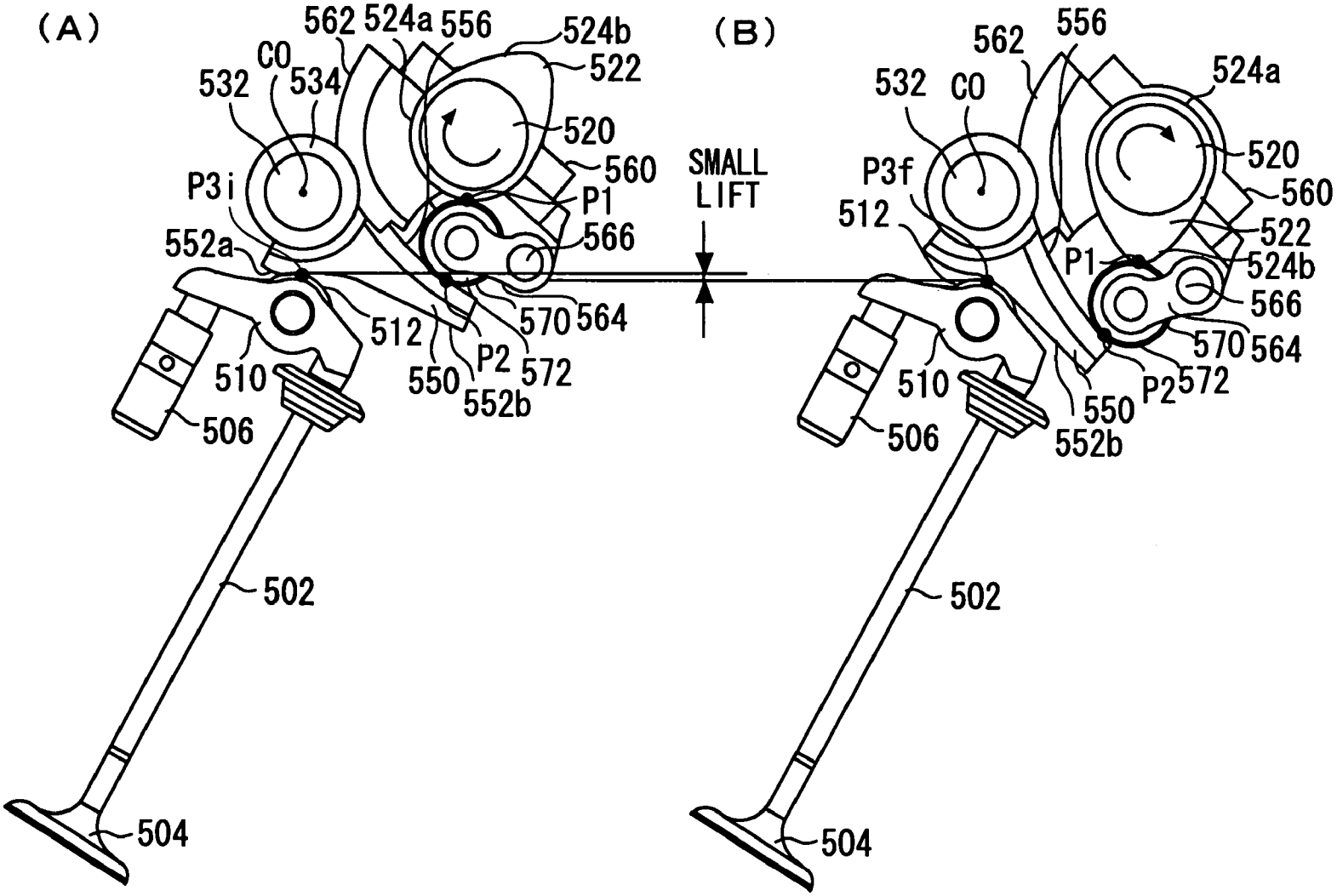
FIG. 25 illustrates a small lift operation performed by the variable valve operating device according to the fourth embodiment of the present invention, in the figure, (A) shows a valve open condition and (B) shows valve closed condition.

When the valve lift amount is changed from the valve lift amount shown in FIG. 24 to the valve lift amount shown in FIG. 25, the control shaft 532 is rotatably driven in the same direction (clockwise in the figure) as the rotational direction of the camshaft 520 in the condition shown in FIG. 24(A), thereby rotating the control arm 560 to the rotation position shown in FIG. 25(A). The amount of rotation of the control arm 560 is determined by the amount of rotation of the control shaft 532 and the gear ratio of the first gear 534 (see FIG. 23) and the second gear 562. The rollers 570, 572 are coupled to the control arm 560 through the control link 564. Accordingly, as the control arm 560 rotates, the first roller 570 moves to an upstream side in the direction of rotation of the camshaft 520 along the drive cam surface 524. The second roller 572, on the other hand, moves along the slide surface 556 in a direction of being away from the control shaft 532.

The movement of the second roller 572 moving in the direction of being away from the control shaft 532 makes longer the distance between a swing center C0 of the swing cam arm 550 and the contact position P2 of the second roller 572 on the slide surface 556. This decreases a swing angle of the swing cam arm 550. This is because the swing angle of the swing cam arm 550 is inversely proportional to the distance between the swing center C0 and the input point of oscillation, i.e., the contact position P2. Referring to (B) in each figure, the lift of the valve 504 becomes the greatest when the contact position P1 of the first roller 570 on the drive cam surface 524 is located at the vertex portion of the operating surface 524*b*. The valve lift amount of the valve 504 is determined by the contact position P3*f* (hereinafter referred to as the final contact position) of the rocker roller 512 on the swing cam surface 552 at that particular point in time. As with the first embodiment (see FIG. 8), the final contact position P3*f* is determined by the aforementioned swing angle of the swing cam arm 550 and the contact position P3*i* (hereinafter referred to as the initial contact position) of the rocker roller 512 on the swing cam surface 552 shown in (A) of each figure.

In the variable valve operating device 500 according to this embodiment, the slide surface 556 is formed so that the greater the distance thereof from the swing center, the greater the distance from the cam base circle (nonoperating surface 522*a*) of the drive cam 522. Accordingly, the farther the aforementioned contact position P2 moves away from the swing center C0 of the swing cam arm 550, the more the swing cam arm 550 is inclined in a direction in which the slide surface 556 approaches the drive cam surface 524. In the figure, the swing cam arm 550 rotates counterclockwise about the control shaft 532. As a result, as shown in FIG. 25(A), the initial contact position P3*i* of the rocker roller 512 on the swing cam surface 552 moves in the direction of being away from the operating surface 552*b*.

By rotating the control shaft 532 in the same direction as the direction of rotation of the camshaft 520 as described above, the swing angle of the swing cam arm 550 decreases and the initial contact position P3*i* moves in the direction of being away from the operating surface 552*b*. As a result, the final contact position P3*f* to be reached by the rocker roller 512 moves on the side of the nonoperating surface 552*a*. This decreases the valve lift amount of the valve 504. The period (crank angle) through which the rocker roller 512 remains located on the operating surface 552*b* is the working angle of the valve 504; however, movement of the final contact position P3*f* onto the side of the nonoperating surface 552*a* decreases the working angle of the valve 504 also. Further, movement of the first roller 570 to the upstream side in the direction of rotation of the camshaft 520 causes the contact position P1 of the first roller 570 on the drive cam surface 524 when the camshaft 520 is at the same rotation position to move toward an advance side of the drive cam 522. This advances swing timing of the swing cam 550 relative to the phase of the camshaft 520, which results in valve timing (maximum lift timing) being advanced.

[Advantages of the Variable Valve Operating Device According to this Embodiment]

As described in the foregoing, according to the variable valve operating device 500 of this embodiment, the rotation position of the control shaft 532 is varied so as to change the contact position P2 of the second roller 572 on the slide surface 556 and the contact position P1 of the first roller 570 on the drive cam surface 524. This, in turn, allows the valve lift amount, working angle, and valve timing of the valve 504 to be varied in association with one another. In this case, forming the slide surface 556 into a curve helps suppress an initial swing position of the swing cam arm 550 from changing excessively relative to the change in the position of the first roller 570 on the drive cam surface 524.

Accordingly, in accordance with the variable valve operating device 500 of this embodiment, an excessive change in the valve lift amount can be suppressed with respect to changes in the valve timing in the same manner as with the variable valve operating device 100 of the first embodiment. It is therefore possible to realize an ideal valve timing-lift characteristic without using in combination the variable valve timing mechanism, such as the VVT or the like, or without having to let the variable valve timing mechanism, should one be used in combination, operate largely. That is, the valve timing-lift characteristic as shown in FIG. 10 or 11 can be realized even with the variable valve operating device 500 of this embodiment.

Further, in accordance with the variable valve operating device 500 of this embodiment, the control arm 560 is mounted on the existing camshaft 520 and the control link 564 mounted on the control arm 560 supports the rollers 570, 572. This arrangement allows the entire device to be structured compactly. Moreover, the length of the control link 564 supporting the rollers 570, 572 near the camshaft 520 can be built short. This helps suppress an increase in the inertia mass of the entire movable portion.

OTHER

While the present invention has been described by reference to various specific embodiments, it should be understood that the present invention is not limited to the aforementioned embodiments and can be implemented in various manners without departing from the spirit thereof. For instance, while the swing cam arm is mounted on the control shaft in the aforementioned embodiments, the swing cam arm shaft may be provided separately from the control shaft.

It is also possible to apply the interlock selecting mechanism according to the first embodiment to any arrangement of the second to fourth embodiments.

Further, while the present invention is applied to the valve operating devices of the rocker arm type in the aforementioned embodiments, it is still possible to apply the present invention to a valve operating device of other type, including a direct action type or the like.

The invention claimed is:

1. A variable valve operating device for mechanically changing the operating characteristic of a valve relative to rotation of a camshaft, comprising:

a drive cam disposed on the camshaft;

a control shaft disposed to extend in parallel with the camshaft, the control shaft being capable of changing the rotation position continuously or stepwise;

a swing member swinging about an axis extending in parallel with the camshaft;

a swing cam surface formed on the swing member, the swing cam surface making in contact with a valve support member for supporting the valve to press the valve in a lifting direction;

a slide surface formed on the swing member so as to oppose the drive cam;

an intermediate member disposed between the drive cam and the swing member, the intermediate member making in contact with both a cam surface of the drive cam and the slide surface; and an interlock mechanism for changing a position of the intermediate member on the slide surface by interlocking with the rotation of the control shaft;

wherein the slide surface is formed to be curved toward the drive cam so that the distance from the center of the camshaft increases from the nearest point from the swing center of the swing member toward the farthest point from the swing center of the swing member within the area which the intermediate member contacts; and wherein the swing cam surface includes a nonoperating surface having a constant distance from the swing center of the swing member and giving the valve no lift and an operating surface disposed to continue into the nonoperating surface so that the distance from the swing center of the swing member becomes gradually greater, and a contact position of the valve support member on the swing cam surface shifts from the nonoperating surface to a side of the operating surface as the swing member swings.

2. The variable valve operating device according to claim 1, wherein the slide surface is formed so that the distance from the center of the camshaft increases with an increase in the distance from the swing center of the swing member.

3. The variable valve operating device according to claim 1, wherein a position of the drive cam in contact with the intermediate member in a circumferential direction at the same rotation position of the camshaft moves to an advance side of the camshaft as the position of the intermediate member on the slide surface is further away from the swing center of the swing member.

4. The variable valve operating device according to claim 1, wherein the intermediate member includes a first roller that makes in contact with the cam surface of the drive cam and a second roller that is rotatable relative to the first roller and makes in contact with the slide surface.

5. The variable valve operating device according claim 1, wherein the swing member is rotatably mounted on the control shaft and rocks about the control shaft.

6. The variable valve operating device according to claim 5, wherein the interlock mechanism includes a control member fixed to the control shaft and having a pivot at a position eccentric from the center of the control shaft and a connecting member mounted rockably on the pivot and connecting the intermediate member to the control member.

7. The variable valve operating device according to claim 6, wherein the control member is formed as a disc having a center at a position eccentric from the control shaft and the connecting member is mounted rotatably on an outer peripheral surface of the disc.

8. The variable valve operating device according to claim 5, wherein the interlock mechanism includes a control member mounted rotatably on the camshaft, a support member mounted on the control member, the support member for supporting the intermediate member movably along a predetermined path, and a rotation interlock mechanism for interlocking the rotation of the control member about the camshaft with the rotation of the control shaft.

9. The variable valve operating device according to claim 8, wherein the support member is formed as a guide integrated with the control member.

10. The variable valve operating device according to claim 8, wherein the support member is formed as a link member mounted on the control member rockably about a position eccentric from the camshaft, the link member providing a link coupling between the control member and the intermediate member.

11. The variable valve operating device according to claim 1, further comprising:

a second drive cam disposed on the camshaft in juxtaposition with the drive cam;

a second swing member disposed coaxially with the swing member, the second swing member being able to swing independently of the swing member;

a second swing cam surface formed on the second swing member, the second swing cam surface making in contact with a valve support member for supporting a second valve disposed in juxtaposition with the valve to press the second valve in a lifting direction;

a third swing member disposed coaxially with the swing member, the third swing member being able to swing independently of the swing member and the second swing member and making in contact with a cam surface of the second drive cam; and interlock selecting means for selectively interlocking the second swing member with either the swing member or the third swing member.

* * * * *